US011384544B2

(12) United States Patent
Lenney

(10) Patent No.: US 11,384,544 B2
(45) Date of Patent: Jul. 12, 2022

(54) GUTTER GUARD WITH IRREGULAR GROOVES

(71) Applicant: GutterGlove, Inc., Roseville, CA (US)

(72) Inventor: Robert C. Lenney, Lincoln, CA (US)

(73) Assignee: GUTTERGLOVE, INC., Franklin, TN (US)

( * ) Notice: Subject to any disclaimer, the term of this patent is extended or adjusted under 35 U.S.C. 154(b) by 0 days.

(21) Appl. No.: 16/862,537

(22) Filed: Apr. 29, 2020

(65) Prior Publication Data

US 2020/0347604 A1 Nov. 5, 2020

Related U.S. Application Data

(60) Provisional application No. 62/841,387, filed on May 1, 2019.

(51) Int. Cl.
*E04D 13/076* (2006.01)
*E04D 13/068* (2006.01)

(52) U.S. Cl.
CPC ..... *E04D 13/076* (2013.01); *E04D 13/068* (2013.01)

(58) Field of Classification Search
CPC .... E04D 13/076; E04D 13/068; E04D 13/064
See application file for complete search history.

(56) References Cited

U.S. PATENT DOCUMENTS 2,674,961 A * 4/1954 Lake ..... E04D 13/076 210/474
3,972,077 A * 8/1976 Whitten, Jr. ..... E04H 4/143 4/496
4,745,710 A * 5/1988 Davis ..... E04D 13/076 210/473
4,937,986 A * 7/1990 Way, Sr ..... E04D 13/076 210/474
5,010,696 A * 4/1991 Knittel ..... E04D 13/076 210/474
5,257,482 A * 11/1993 Sichel ..... E04D 13/076 52/12
5,321,920 A * 6/1994 Sichel ..... E04D 13/076 52/12
5,406,755 A * 4/1995 Serano ..... E04D 13/076 210/474
5,660,001 A * 8/1997 Albracht ..... E04D 13/076 52/12
5,813,173 A * 9/1998 Way, Sr. ..... E04D 13/076 210/474

(Continued)

*Primary Examiner* — Jessie T Fonseca
(74) *Attorney, Agent, or Firm* — Jonathan Kidney; Glen L. Gross; Intelink Law Group, P.C.

(57) ABSTRACT

A self-supporting gutter guard device is described having a bridge member composed of a decking material having a plurality of orifices, and having a roof side and an opposing gutter lip side, at least one groove disposed in the decking material altering a profile of the deck material to outline a 3-dimensional geometry that spans the bridge member from a proximal end of the bridge member's roof side to a proximal end of the bridge member's gutter lip side, a roof attachment member configured to attach to the roof side of the bridge member, and a gutter attachment member configured to attach to the gutter lip side of the bridge member, wherein the 3-dimensional geometry of the at least one groove enables the device to be self-supporting.

31 Claims, 28 Drawing Sheets

(56) References Cited

U.S. PATENT DOCUMENTS

| | | | | | |
|---|---|---|---|---|---|
| 6,016,631 | A * | 1/2000 | Lowrie, III | E04D 13/076 | 52/12 |
| 6,151,837 | A * | 11/2000 | Ealer, Sr. | E04D 13/076 | 52/11 |
| 6,349,506 | B1 * | 2/2002 | Pace | E04D 13/076 | 52/11 |
| 6,363,662 | B1 * | 4/2002 | Coates | E04D 13/076 | 362/147 |
| 7,743,561 | B1 * | 6/2010 | Frederick | E04D 13/064 | 52/11 |
| 7,946,081 | B1 * | 5/2011 | Frederick | E04D 13/064 | 52/11 |
| 8,297,000 | B1 * | 10/2012 | Demartini | E04D 13/076 | 52/12 |
| 2007/0214731 | A1 * | 9/2007 | Bachman | E04D 13/076 | 52/12 |
| 2011/0138697 | A1 * | 6/2011 | Martin | E04D 13/076 | 52/12 |
| 2013/0091780 | A1 * | 4/2013 | Robins | E04D 13/076 | 52/12 |
| 2013/0160378 | A1 * | 6/2013 | Higginbotham | E04D 13/002 | 52/12 |
| 2015/0089883 | A1 * | 4/2015 | Peck | E04D 13/076 | 52/12 |
| 2015/0225959 | A1 * | 8/2015 | Lenney | E04D 13/064 | 52/12 |
| 2015/0225960 | A1 * | 8/2015 | Bryer | E04D 13/076 | 52/12 |
| 2020/0217074 | A1 * | 7/2020 | Graves | E04D 13/076 | |

* cited by examiner

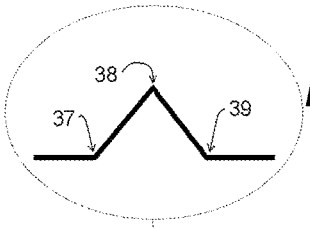
Fig. 4
Fig.3
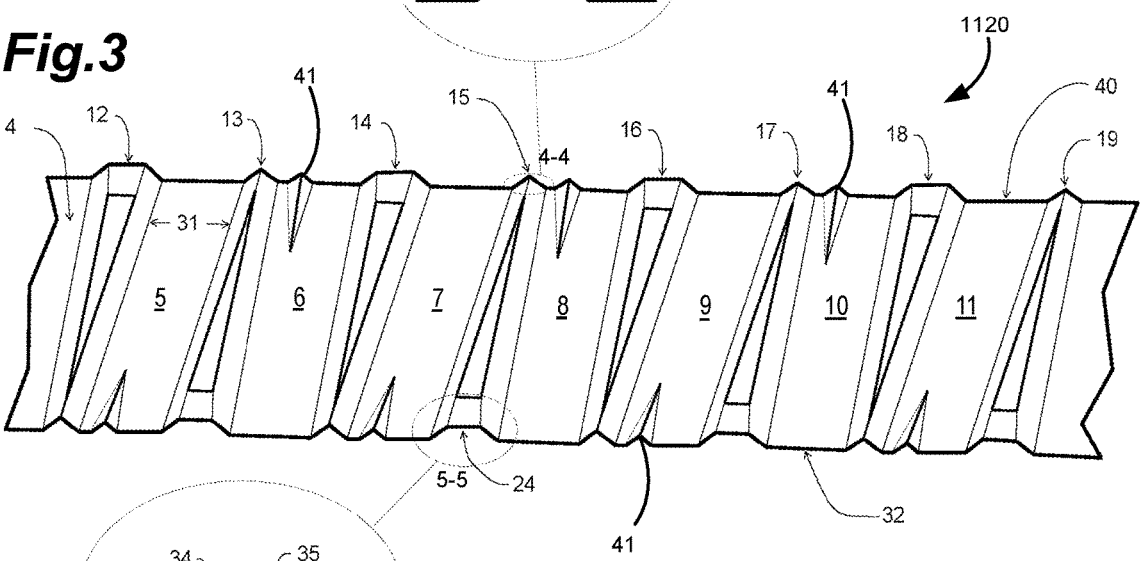
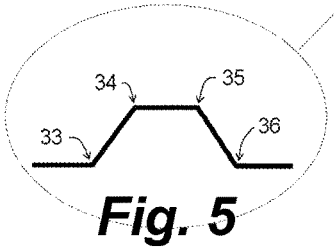
Fig. 5
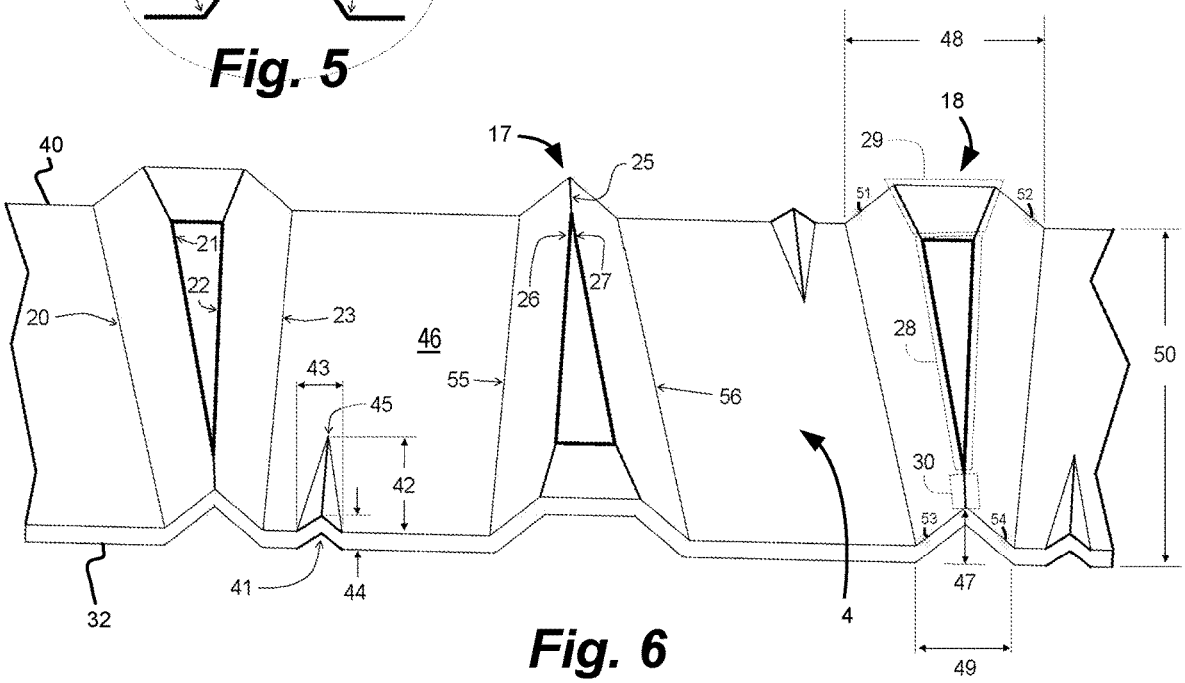
Fig. 6

Fig. 13
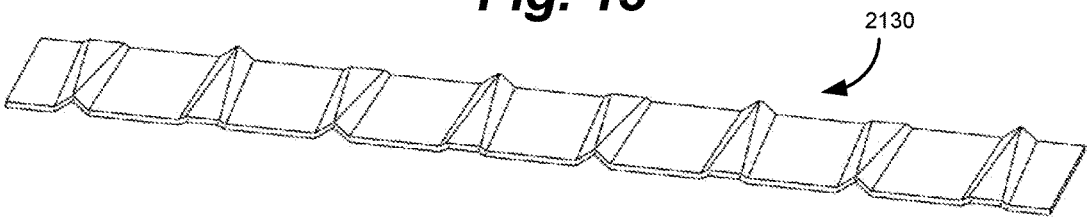
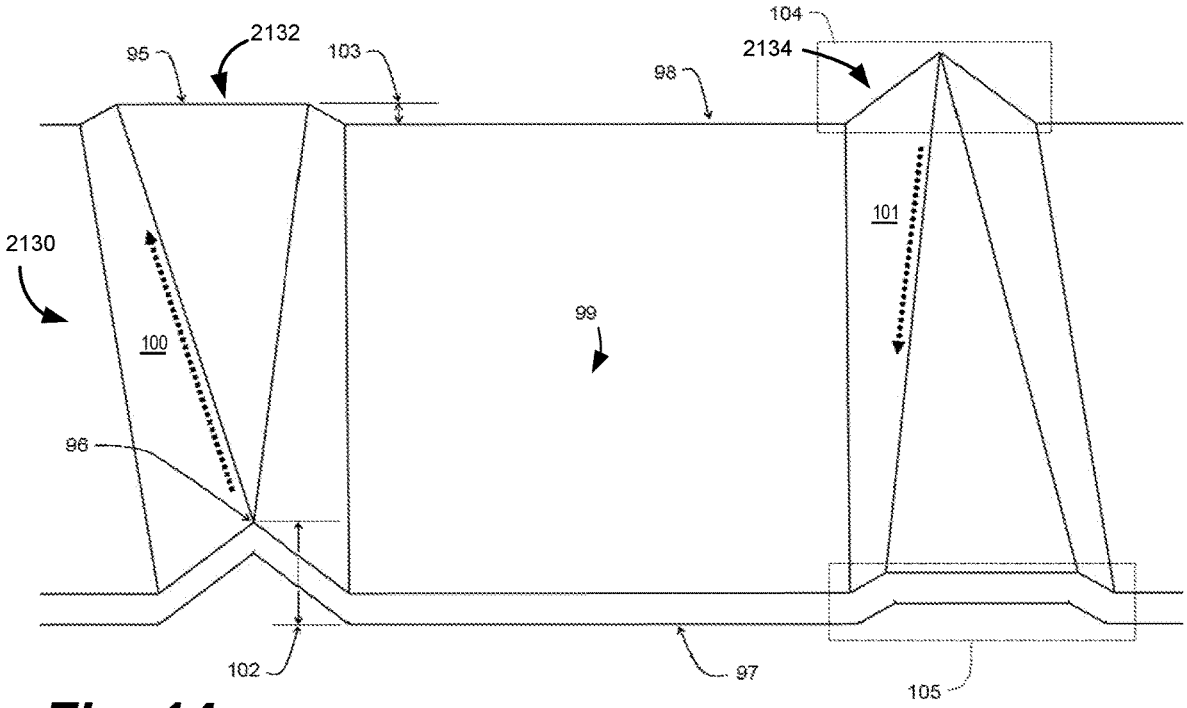
Fig. 14
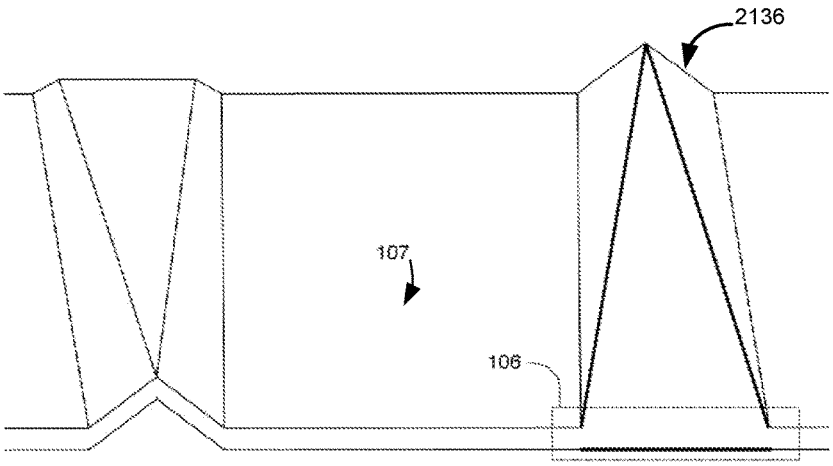
Fig. 15

Fig. 16
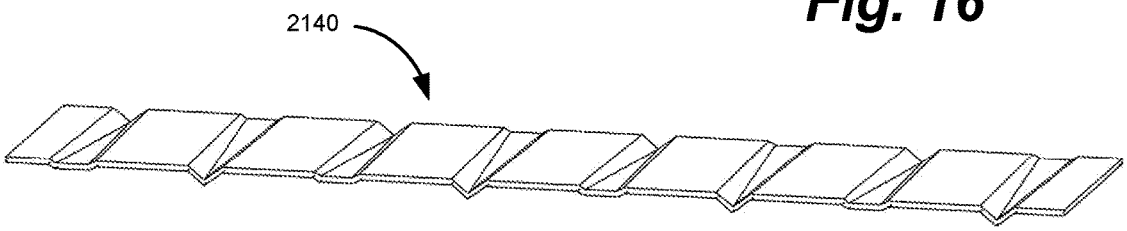
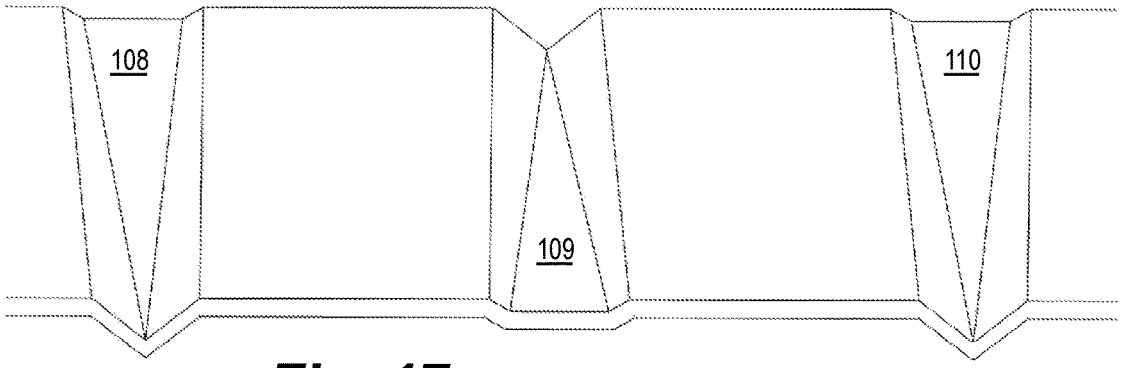
Fig. 17
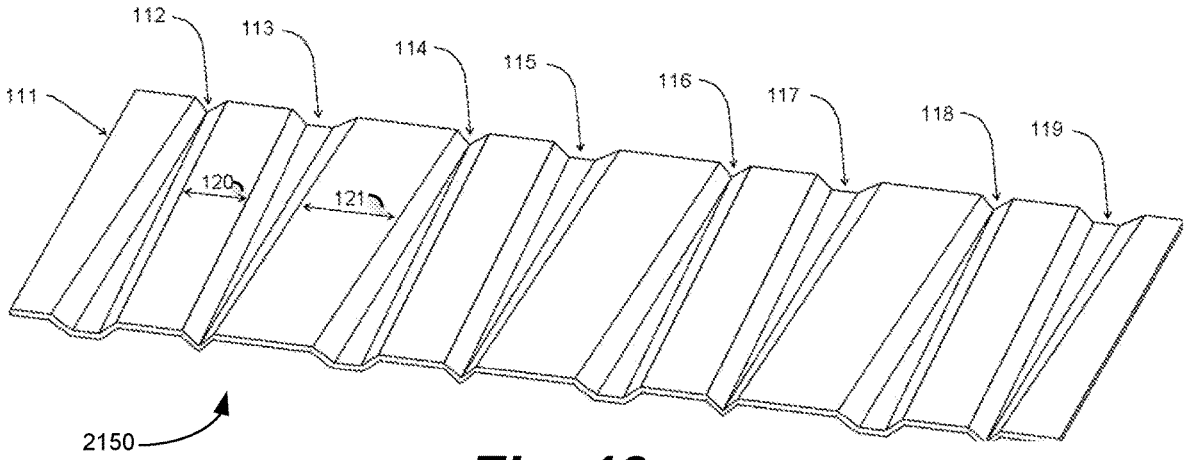
Fig. 18

Fig. 21
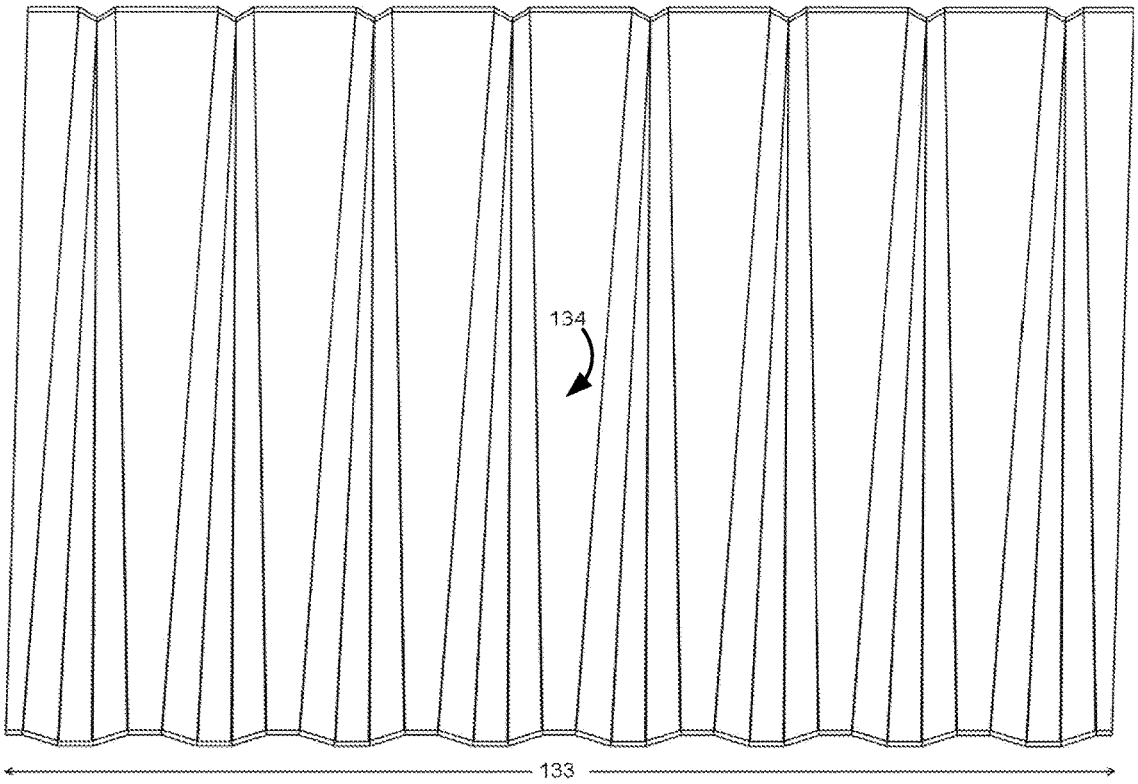
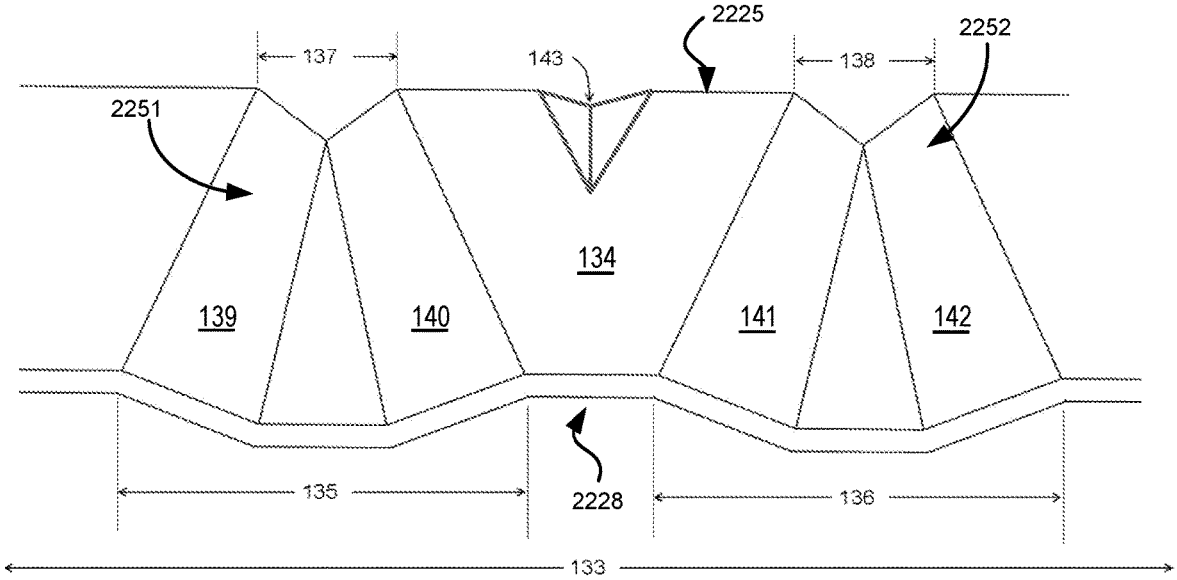
Fig. 22

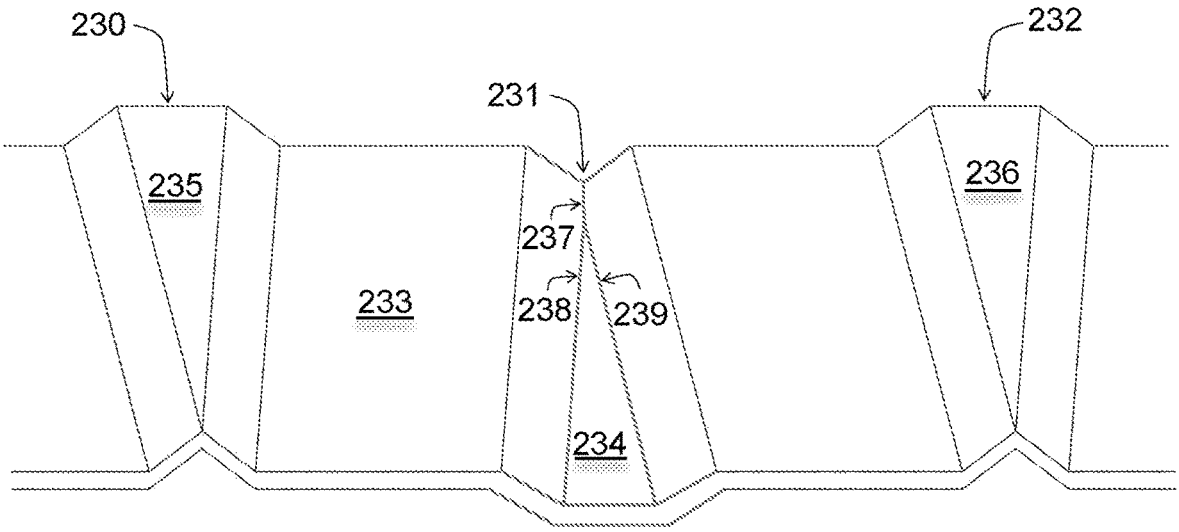
Fig. 54
Fig. 55
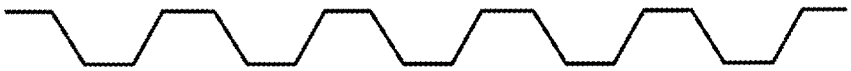
Fig. 56
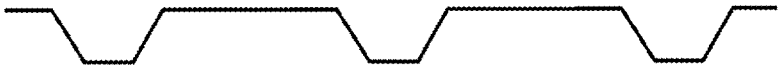
Fig. 57
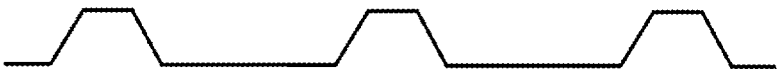
Fig. 58
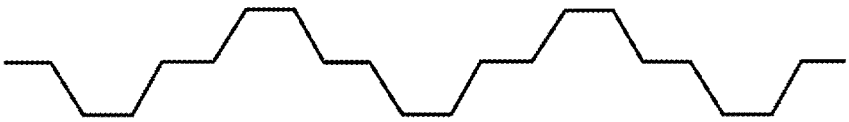
Fig. 59
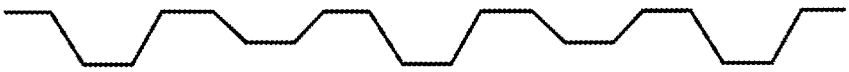

GUTTER GUARD WITH IRREGULAR GROOVES

CROSS REFERENCE TO RELATED APPLICATION(S)

This nonprovisional application claims the benefit and priority of U.S. Provisional Application No. 62/841,387, filed on May 1, 2019, titled "Bifurcated Arched Gutter Bridge;" the above-identified application being incorporated herein by reference in its entirety.

BACKGROUND

Field

This invention relates to gutter guards and protecting gutters from having debris entering the gutter while still allowing water to flow into the gutter.

Description of Related Art

Rain gutters are generally attached to buildings or structures that have a pitched roof. The gutters are designed to collect and divert rainwater that runs off the roof. The gutter channels the rainwater (water) to downspouts that are connected to the bottom of the gutter at various locations. The downspouts divert the water to the ground surface or underground drainage system and away from the building.

Gutters have a large opening, which runs parallel to the roofline, to collect water. A drawback of this large opening is that debris, such as leaves, pine needles and the like can readily enter the opening and eventually clog the gutter. Once the rain gutter fills up with debris, rainwater can spill over the top and on to the ground, which compromises the effectiveness of the gutter, causes water damage to the home and erodes surrounding landscapes.

A primary solution to obstruct debris from entering a gutter opening is the use of debris preclusion devices, most commonly known in the public as gutter guards. Gutter guards are also generically referred to as gutter covers, eaves guards, leaf guards or, alternatively via the more technical terms gutter protection systems, debris obstruction device (DOD), debris preclusion devices (DPD) or gutter bridge, etc. Gutter guards/DOD types abound in the marketplace and the industry is constantly innovating to find more efficient configurations that not only keep debris, such as leaves and pine needles out of the gutter, but also even tiny roof sand grit. Concomitant with these innovations are the challenges of achieving self-supporting systems that are simple (e.g., low cost, single piece, easy to fabricate, etc.) as well as systems designed to maintain effectiveness (e.g., durable, easy-to-install, minimal maintenance, etc.) in heavy weather conditions.

In view of the above, various systems and methods are elucidated in the following description, that provide innovative solutions to one or more deficiencies of the art.

SUMMARY

The following presents a simplified summary in order to provide a basic understanding of some aspects of the claimed subject matter. This summary is not an extensive overview and is not intended to identify key/critical elements or to delineate the scope of the claimed subject matter.

Its purpose is to present some concepts in a simplified form as a prelude to the more detailed description that is presented later.

As one example, one or more embodiments of the exemplary gutter debris obstruction devices, (i.e. gutter guard) can be self-supporting via use of a plurality of grooves.

Further, one or more embodiments of the exemplary gutter guard devices do not require a "separate" framed support under it.

Still further, one or more embodiments of the exemplary gutter guard devices do not require attachment brackets to attach the device to a gutter or a building.

Yet further, one or more embodiments of the exemplary gutter guard devices do not need to employ corrugations to add strength to the device.

Yet, in other embodiments of the exemplary gutter guard devices, the presence of grooves (some shown as irregular grooves) provide a greater "flat" area or water penetration area than conventional corrugated gutter guards.

In other embodiments, the presence of the grooves enables the gutter guard device to be self-supporting.

And further, in other embodiments of the exemplary gutter guard devices, the use of irregular grooves assists in reducing the lodging of debris on the device.

Further, in other embodiments of the exemplary gutter guard devices, greater static and dynamic loads can be handled by the device.

For example, in one aspect of an embodiment, a gutter guard device is provided comprising: a bridge member composed of a decking material having a plurality of orifices, and having a roof side and an opposing gutter lip side; at least one groove disposed in the decking material altering a profile of the deck material to outline a 3-dimensional geometry that spans the bridge member from a proximal end of the bridge member's roof side to a proximal end of the bridge member's gutter lip side; a roof attachment member configured to attach to the roof side of the bridge member; and a gutter attachment member configured to attach to the gutter lip side of the bridge member; wherein the 3-dimensional geometry of the at least one groove enables the device to be self-supporting.

In another aspects of various embodiments, the above is described, wherein the at least one groove forms an inverted channel across the bridge member; and/or wherein a plane of a top surface of the at least one groove is at an inclination or declination to a plane of the decking material; and/or wherein the at least one groove is attached to the bridge portion; and/or wherein the at least one groove is irregular, having a cross-sectional profile that is not constant along a major axis of the at least one groove; and/or wherein the 3-dimensional geometry is a polygon; and/or wherein a first cross-sectional profile of the at least one groove has a shape of at least one of a hexagon, half-hexagon, triangle, box, sinusoid, off center, dip, and V; and/or wherein a second cross-sectional profile of the at least one groove has a different shape than the first cross-sectional profile's shape; and/or wherein a second cross-sectional profile of the at least one groove has a different size than a size of the first cross-sectional profile's shape; and/or a first groove of the at least one groove is in a reversed orientation to a second groove of the at least one groove; and/or wherein a first groove of the at least one groove is adjacent and displaced a first distance from a second groove of the at least grooves to form a first set of grooves, the first set of grooves being displaced from a different set of grooves by a second different distance; and/or wherein the first set and another set of grooves are in reverse orientation to each other; and/or further comprising a crease disposed in the decking material in at least one of the roof side and a gutter lip side of the bridge member, the crease extending partially across the bridge member and compensating for the at least one groove's use of the decking material; and/or wherein the crease outlines a polygonal shape; and/or wherein a surface of a groove of the at least one groove is faceted with joined polygons, the joined polygons forming a triangular profile at a first end of the groove and forming a half-hexagonal profile at an opposite end of the groove; and/or a first groove of the at least one groove is adjacent and displaced a first distance from a second groove of the at least grooves, the first and second grooves composed of joined segmented archways and sharing a ramp therebetween to form a skyway, and wherein a third groove of the at least one groove is displaced a second distance from the skyway, the third groove composed of joined smaller segmented archways; and/or wherein adjacent grooves of the at least one groove form a series of mid-point shifted grooves, wherein first ends of the adjacent grooves have an upper half-hexagonal profile disposed above a plane of the bridge portion and opposite ends of the adjacent grooves have a lower half-hexagonal profile disposed below the plane of the bridge portion; and/or wherein the bridge member is a micro-mesh material; and/or wherein the micro-mesh material is pre-tensioned; and/or wherein the micro-mesh includes inter-woven diagonal strands of material; and/or wherein the bridge member is a perforated sheet of aluminum; and/or wherein the at least one groove is a plurality of grooves; and/or wherein a first groove of the at least one groove has a different height than a second groove of the at least one groove; and/or further comprising at least one barricade disposed in the bridge member; and/or wherein the at least one barricade has a shape of a number, letter, circle, arrow, crescent, bump, dimple, and polygon; and/or wherein the at least one barricade is a plurality of barricades; and/or wherein the at least one barricade is not made from the bridge member's decking material; and/or wherein at least one of the roof attachment member and gutter attachment member have a receiving center configured for securing the bridge member to the respective attachment member; and/or the bridge portion contains a trough proximal to its gutter lip side.

In yet another aspect of an embodiment, a gutter guard is provided, comprising: a rear beam; a decking having a plurality of orifices, a top surface and an opposing bottom surface, wherein the plurality of orifices extend from the top surface to the bottom surface, and wherein the decking has a front edge and rear edge; and at least one groove disposed in the top surface of the decking; a front beam, wherein the rear edge of the decking is attached to the rear beam and the front edge is attached to the front beam.

These and other features are described in, or are apparent from, the following detailed description of various exemplary embodiments of the devices and methods according to this invention.

BRIEF DESCRIPTION OF THE DRAWINGS

Various exemplary embodiment of this invention will be described in detail, with reference to the following figures:

FIG. 3 is a partial front, left perspective view of an exemplary bridge portion.

FIG. 4 is a blown-up profile view of an end of groove.

FIG. 5 is a blown-up profile view of an opposing end of the groove of FIG. 4.

FIG. 6 illustrates a blown-up view of several of the grooves shown in FIG. 3.

FIG. 13 is a wide top perspective view of another exemplary bridge portion.

FIG. 14 is a top perspective close-up view of FIG. 13's irregular groove.

FIG. 15 is a top perspective close-up view of a variation of the embodiment shown in FIG. 14.

FIG. 16 is a wide top perspective view of another exemplary bridge portion, having irregular grooves.

FIG. 17 shows a partial top perspective view of an exemplary bridge portion with irregular grooves.

FIG. 18 shows an alternative embodiment of an exemplary bridge portion irregular grooves.

FIG. 21 is a wide top perspective view of another exemplary bridge portion, having irregular grooves.

FIG. 22 is a closeup view of the embodiment shown in FIG. 21.

FIG. 54 displays a bottom, front perspective view of a portion of an alternative embodiment of an exemplary bridge portion.

FIG. 55 illustrates a rear view of a bridge portion having a plurality alternating irregular grooves.

FIG. 56 illustrates a rear view of a bridge portion having a plurality downward irregular grooves.

FIG. 57 illustrates a rear view of a bridge portion having a plurality upward irregular grooves.

FIG. 58 illustrates a rear view of a bridge portion having a plurality of cross plane irregular grooves.

FIG. 59 illustrates a rear view of a bridge portion having a plurality of irregular grooves with varying groove heights.

DETAILED DESCRIPTION

Figure 1:
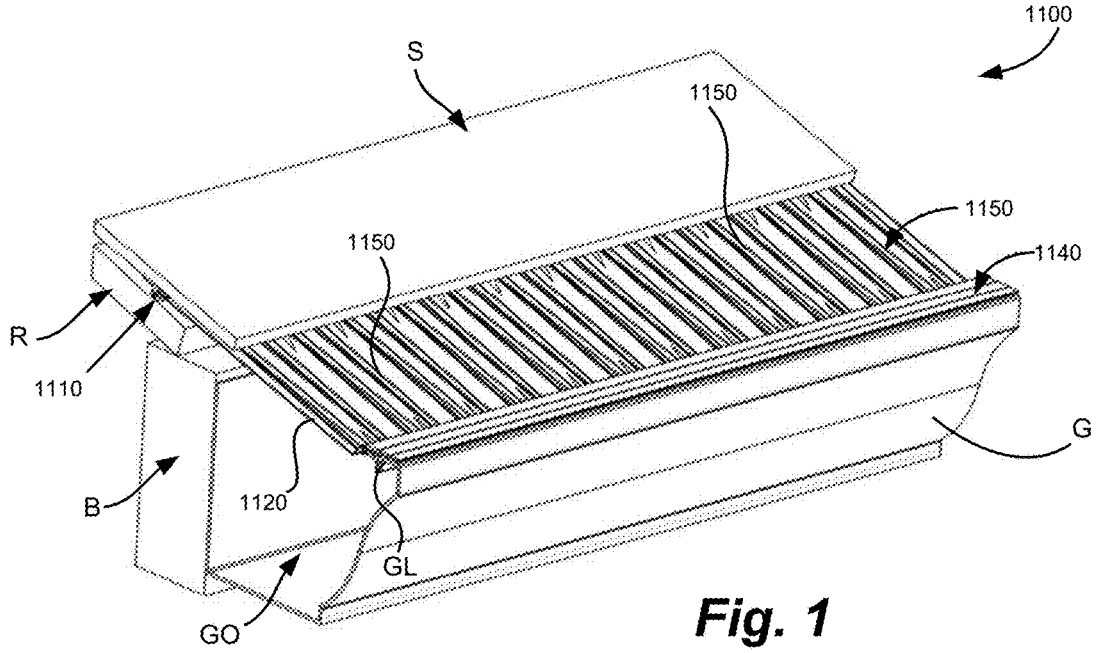
FIG. 1 shows an exemplary embodiment of a device made in accordance with the present invention, installed over a gutter.

It should be appreciated that the most commonly used term to describe a debris obstruction (or preclusion) device (DOD) for a rain gutter is gutter guard. However, as stated above, alternate terms are used in the industry (generally from product branding), denoting the same or essentially same purpose of preventing or obstructing the entrance of external debris (e.g., non-water material) into the rain gutter, whereas the gutter can be protected so as to operate effectively. Thus, recognizing the layman may interchangeably use these terms to broadly refer to such devices, any such use of these different terms throughout this disclosure shall not be interpreted as importing a specific limitation from that particular "brand" or "type" of gutter device. Accordingly, while a DOD or gutter bridge may be a more technically accurate term, unless otherwise expressly stated, the use of the term gutter guard, gutter cover, leaf guards, leaf filter, gutter protection systems, gutter device, gutter guard device, and so forth, may be used herein without loss of generality.

The most conventional DOD is a one-piece gutter guard generally made of sheet materials such as plastics or metals, which tend to have very thin profiles. With such a thin profile, they do not exhibit sufficient internal support for live loads (leaves and other organic debris moving across the gutter guard), or dead loads (leaves and other organic debris sitting static on the gutter guard) and so can collapse after installation.

With the introduction of a stainless-steel type micromesh DOD, a complicated rigid frame type support was required under the micromesh to hold it up so it would not collapse under load, such as seen in U.S. Pat. Nos. 7,310,912 & 8,479,454 to Lenney and U.S. Pat. Nos. 7,191,564 & 6,951,077 to Higginbotham.

To avoid the use of complicated support or frame structures, corrugations in a stainless steel micromesh DOD were first used as seen in U.S. Pat. No. 9,021,747 to Lenney. According to dictionary definitions, corrugations consist of a series of parallel ridges and parallel grooves to give added rigidity and strength. The '747 patent's corrugations provided sufficient rigidity in the (micro)mesh itself so that it could span over the top of a gutter without collapsing.

However, self-supporting corrugated DODs tend to have a large percentage of the decking surface covered with corrugations. Some, for example, have 40% or higher of their decking surface made with these corrugations. While the corrugations provide some rigidity to the mesh, numerous conventionally designed corrugations along the longitudinal axis do not always provide enough of a permeable flat surface along the planar areas of the decking to allow debris to roll off the guard. Therefore, having a "self-supporting" gutter cover with more flat and/or permeable surfaces would address many of the problems in the prior art.

In view of the above, improved designs for allowing the mesh (or bridge) to span the gutter opening using grooves of various types, shapes, and arrangements, as well as different mesh qualities, groove angles and structures and so forth are described below and shown in the following Figures. It is understood that the following Figs illustrate embodiment using a mesh or micro-mesh decking material having orifices throughout its entirety. In some embodiments, the mesh may be substituted with metal sheet with perforations, as is well known and common in the art. For ease of viewing the orifices or perforations (in the mesh and/or the metal sheet) are not shown in most of the Figs, but are evident in the photo-illustrations of FIGS. 67, 79-80 and also seen in FIGS. 86-88.

Figure 2:
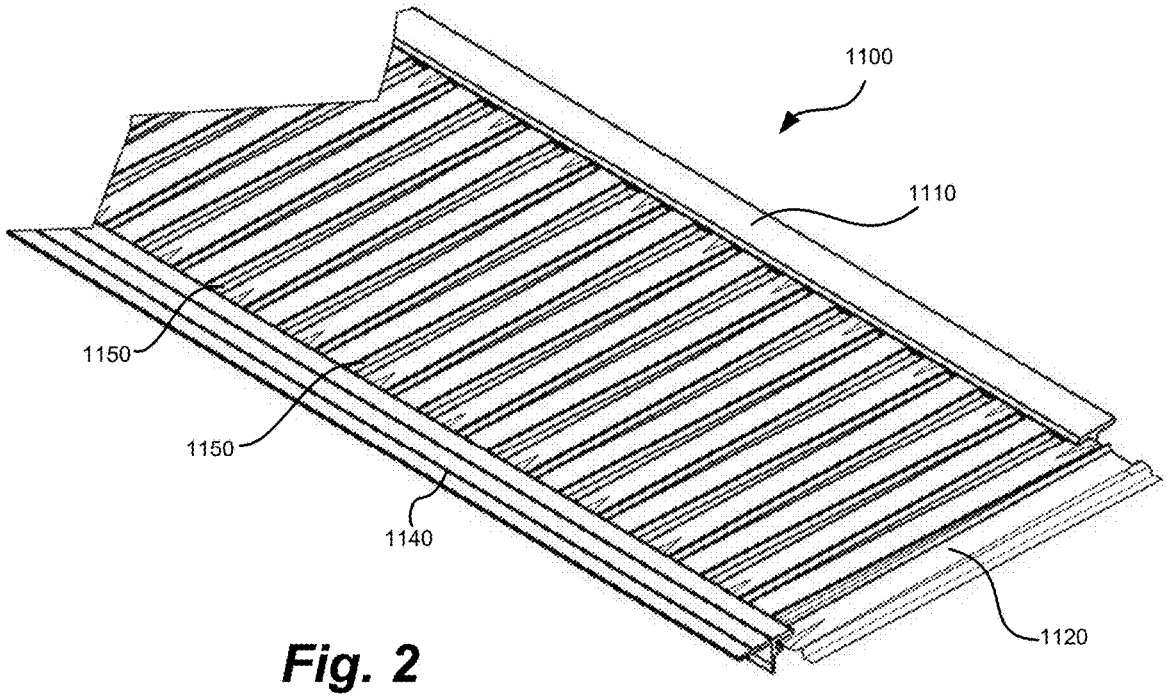
FIG. 2 shows a partial perspective view of the exemplary device.

FIGS. 1-2 display views of an embodiment of a self-supporting exemplary gutter guard device 1100. FIG. 1 shows the exemplary device 1100, installed over a gutter G. FIG. 2 shows a partial perspective view of the exemplary device 1100 alone.

As shown in FIGS. 1 and 2, the device 1100 includes a roof attachment member (hereafter referred to as roof attachment portion) 1110, a bridge member (hereafter referred to as bridge portion) 1120, and a gutter attachment member (hereafter referred to as gutter attachment portion) 1140, and at least one groove 1150. The bridge portion 1120 of the device 1100 is disposed between the roof attachment portion 1110 and the gutter attachment portion 1140. The at least one groove 1150 is disposed within the bridge portion 1120. The at least one groove 1150, in this embodiment is a plurality of grooves.

FIG. 1 shows a partial perspective view of the exemplary device 1100. The device 1100 is operably configured to be installed and disposed over a gutter G. The gutter will have a gutter opening GO, which without a gutter guard will readily collect debris falling from nearby trees and the roof. The gutter G is attached to the building B. The building B, the roof R and the gutter G are represented in this Fig. without great detail as any conventional elements of those items may be utilized and are only shown here to show application for the devices of the present invention. It will be appreciated that the roof R may have shingles S, which can be any type of conventional roofing material, including asphalt shingles, slate, tile roofing, etc. It will further be appreciated that the gutter G is configured to capture liquid, generally rainwater RW, (not shown), that flows down the roof R and into the gutter G. The gutter G has a gutter lip GL. The device 1100, when in use is disposed above the gutter opening GO. The device 1100 is operably configured to span over the entire gutter opening GO. The device 1100 extends from the roof R to the gutter lip GL. The device 1100, along with other embodiments, will allow rainwater RW to pass from a top surface of the device 1100 through the device 1100 and into the gutter G, while preventing a substantial amount of debris from falling into the gutter G. Additionally, the device 1100, along with other embodiments, will enable nearly all of the rainwater RW to fall into the gutter G and not run over the gutter lip GL. The device 1100 is shown in this figure to be installed onto the building B, which, in this embodiment, is "in-line" or an acute angle from the roof's R slope angle.

The bridge portion 1120 is in this embodiment can be made from a micromesh material, or other equivalent performing material. In some embodiments, the micromesh material is a stainless-steel micromesh. The bridge portion 1120 includes a plurality of orifices (not shown). For purposes of clarity, the orifices inherently present in a micromesh are not shown, as evident in FIGS. 1 and 2, and in subsequent Figs. It should be appreciated that the bridge portion 1120 may in other embodiments be made from alternative materials whether micromesh or not. In some embodiments, the roof attachment portion 1110 and the gutter attachment portion 1140 can be made from aluminum, plastic or other equivalent performing material.

The at least one groove 1150 provides support for the device, such that the device, when in use, is capable of spanning the gutter opening without the need for other supporting features, such as an underlying rigid frame support, a plurality of corrugations formed in the mesh or the like. It will be appreciated that the at least one groove can in other embodiments be combined with these other structural supports as well to even further increase the load carrying capacity of the device.

FIG. 3 is a partial top, front, right perspective view of an exemplary bridge portion 1120 applicable for use in the device 1100 of FIG. 1. The bridge portion 1120 is in this embodiment includes a micromesh decking 4. For clarity the plurality of orifices in the decking material 4 is not shown. FIG. 3 shows the decking 4 having a plurality of facets, of parallelogram planar sections 5, 6, 7, 8, 9, 10 and 11. The decking 4 also includes at least one irregular groove, illustrated here as a plurality of grooves 12, 13, 14, 15, 16, 17, 18 and 19. Further, in this embodiment, the grooves are shown as non-parallel raised transitional grooves. The grooves are also separated from each other on the decking 4. The bridge portion also includes at least one crease (creased groove 41). The at least one crease is disposed at the ends of the bridge portion 1120 between adjacent grooves. It is understood that a crease may appear as a groove and does exhibit some of the attributes of a groove, however, it is localized to the ends of the decking, extending inward only so as to provide the necessary balancing of the mesh material.

Adjacent grooves are spaced apart at a separation width 31. These and other features will be detailed and discussed below. As should be appreciated, the details of the various features here and in other Figs. may not be to scale.

It is understood that in various embodiments described herein, all or most of the bridge portion is composed or made from a decking material. The decking material being a sheet material or mesh material, etc. is part of the bridge portion in the exemplary device. Therefore, when this disclosure refers to the decking material, it is understood that the reference inherently applies to the exemplary device's bridge portion and, therefore the term decking material and bridge portion may be used interchangeably within the context being described.

It is expressly understood that the grooves described herein may be downward-facing (into the gutter) and/or upward-facing (away from the gutter). Therefore, when the term groove is used, the orientation (up and/or down, otherwise) of the groove will be evident from the context of the embodiment being described.

FIG. 4 is a blown-up profile view of an end of groove 15 along Circle 4-4 of FIG. 3's bridge portion 1120, showing one of many possible end shapes of the groove 15.

FIG. 5 is a blown-up profile view of an opposing end of the groove 15 along Circle 5-5 of FIG. 3's bridge portion 1120, showing one of many possible end shapes of the groove 15. FIG. 5 can be seen as half hexagon profile shape 24 of the irregular groove 15 at the front 32 of the micromesh decking 4, having four ridges 33-36 and transitioning into the triangle shape 15 having three ridges 37-39 (shown in FIG. 4) at the opposite end 40.

In the context of the exemplary embodiments described herein, an irregular groove is understood to outline a 3-dimensional structure where the cross sectional shape of the structure (along the path of the groove) varies or changes at different points on the groove's path. The path of the groove is understood to laterally extend, in most embodiments, from front to back (or vice versus) of the bridge portion or approximately thereto. The shape and path of the groove operate to produce a "channel" (or inverted channel) across the bridge portion, which provides a rigidity to the mesh to render that section to be partly or wholly self-supporting.

It is noted that because an irregular groove is a 3-dimensional structure (as is a regular groove), grooves are not to be confused as being equivalent to a corrugation. Specifically, a corrugation is typically composed of one to three simple proximal bends, limited both in height and width (usually less than 2-5 mesh gaps high or 2-5 mesh gaps wide). Corrugations are generally uniformly disposed along the mesh and are wholly defined by its 2-D profile. The profile formed by a corrugation defines the entirety of that corrugation. In contrast, grooves are a series of different bends displaced from each other, to define a geometric three-dimensional shape that is several orders larger than a corrugation. While it can be argued that a bend in the groove may be a corrugation (2-D), the groove is not defined by that single bend but by a series of them and by the overall 3-D shape formed from the combination of that series. The complexity and scale of geometries that grooves are able to present are not possible with a single corrugation. To analogize a corrugation as the same as a groove is as incorrect as stating a line is the same as a polygon.

Having understood that a groove is not a corrugation, an aspect of an irregular groove is it can be (but not necessarily) asymmetrical in shape. One possible test for asymmetry is if two or more edge lines defining the irregular groove are not parallel to each other.

It should be noted that, as a matter of convenience, when discussing irregular grooves, this description will often simply refer to them as grooves. Therefore, when the term groove is used in the context of a discussion on irregular grooves, it shall be interpreted as referring to irregular grooves. The context of the description will provide the necessary interpretation. If the context is not evident, then the applicable groove type may be applied.

FIG. 6 illustrates a blown-up view of several of the irregular grooves shown in FIG. 3. The profile shape of the grooves transition along the length of the groove. For example, groove 15 has a triangular profile shape at one end 40, as shown in FIG. 4 and a half hexagonal profile shape 24 at the opposing end 31, as shown in FIG. 5.

Grove 16 includes edges (ridges) 20, 21, 22 and 23, as shown in FIG. 6. These edges are not parallel to each other. The groove 17 is a bifurcated irregular groove. The groove 17 has a top planar area that does not span the entire distance from the front to the rear of the bridge portion. Rather, the groove has a top chord 25 and two sub-chords 26 and 27. The top chord bifurcates into the two chords 26 and 27. Moreover, a top plane 28 of the irregular grooves are raised higher than an angled back plane 29 and a linear angled single top chord 30, as shown in FIG. 6. It will be appreciated that the top chord 25, or top ridge, can bifurcate into two chords, or two ridges, on standard height, non-raised or non-standard, raised irregular grooves. Thus, grooves 12, 13, 14, 15, 16, 17, 18 and 19 are irregular grooves and the above describe features apply to all of them.

In this embodiment, each irregular groove is separated from each other by an open area of micromesh decking 5, 6, 7, 8, 9, 10 and 11, as shown in FIG. 3. It will be appreciated that the distance 31 (see FIG. 3) between adjacent irregular grooves, such as grooves 12 and 13, can be increased depending on a height of the adjacent grooves as for example, a height 47 shown in FIG. 6. This is based on the assumption that a back length 48, a front length 49 and a width 50 are the same, and these dimensions are dependent upon the gutter opening width for which the device is being used for. As the irregular groove increases in height, the total footprint of the groove stays the same, which means that angled walls 51, 52, 53 and 54 of the grooves become more acute. As the grooves are 180 degrees alternated from each other, ridge line 20 is parallel, or substantially parallel to ridge line 56 of an adjacent irregular groove and a ridge line 23 is in parallel, or substantially parallel to a ridge line 55 on the adjacent irregular groove. However, in some embodiments, these ridge lines may not be parallel, depending on the groove shape and design objectives.

As seen in FIG. 6, crease (or creased groove) 41 starts out shaped as a triangle and transitions flat into the planar micromesh decking 45. The creased groove 41 has an isosceles triangular profile (an inverted "V"), but can also be equilateral or other-angled. The crease's 41 shape can be prism-like, can be any shaped polygon, irregular polygon or any non-straight shape such as a rounded arc, and so forth. One function of the crease 41 is to balance and even the area of micromesh decking 4 from the front 32 to the back 40 when the planar apex 28 is higher than the front 32 and back 40. The crease can also be utilized in designs, wherein when applying fabrication or grooves to the decking during manufacturing, causes an uneven area of mesh. If more micromesh is being used to form the grooves, in areas of the micromesh than others from the front 32 to the back 40, or visa-versa, it may be difficult to bend the mesh in the manufacturing process and thus creases make the process easier. Calculations of the total area of mesh along the front 32 to the back 40, or visa-versa, are made, then whatever areas are not even in the calculations will be created in the creases 41 to offset and balance the uneven area (examples are shown in Table B below).

The crease 41 has a length 42, a width 43 and a height 44 dimensions, as shown in FIG. 6. These dimensions are dependent on the length and width of the top planar section 28 and "lowered" sections 29 and 30 of the groove 18 formed in micromesh decking 4. It will be appreciated that the crease 41 can be fabricated and formed anywhere on the planar micromesh decking area 4, including next to or adjacent to an irregular groove. The crease 41 can be of any length, width or height within the micromesh decking 4. The crease 41 can extend all the way across the micromesh decking 4 or just part way. Further the crease 41 does not have to be formed along the front 32 or back edge 40 of the micromesh decking 4.

It will be appreciated that the crease 41, while being shown positioned "away" from the grooves or as a completely separate formation, the crease 41 (or a portion of it) can also be formed partially or fully on a side wall or ramp of a groove, if so desired.

The main axis of the creases and grooves are perpendicular to the front 32 and back 40 of the decking 4. It will be appreciated that in other embodiments, the grooves and/or creases do not have to be perpendicular to the front 32 and/or back 40 of the micromesh decking 4. They can be angled anywhere from 0-80 degrees from the front 32 to the back 40, or back 40 to the front 32 of the micromesh decking 4. Irregular grooves can have a variety of orientations, angles, contour shapes along their lateral length from the front 32 to the back 40, or from the back 40 to the front 32 of the micromesh decking 4.

Table A shows preferred ratios for the distance between grooves on a standard 5-inch gutter, using a 5.5 inch sized exemplary device with a surface area of mesh approximately 4.375 inches in width.

TABLE A

Ratios for the distance between grooves on a standard 5-inch gutter, using a 5.5 inch sized exemplary device with a surface area of mesh approximately 4.375 inches in width.

| Irregular Groove Height | Distance Between Grooves |
|---|---|
| 0.063 inches | 0.242 inches |
| 0.063 inches | 0.604 inches |
| 0.125 inches | 0.966 inches |
| 0.125 inches | 1.328 inch |
| 0.187 inches | 1.69 inches |
| 0.218 inches | 2.052 inches |
| 0.249 inches | 2.414 inches |

It will be appreciated, from the above, that by being able to increase the distance between irregular grooves the total area of the planar mesh between the grooves increases, thus allowing for a greater area to filter water through the device and into the gutter.

Figure 7:
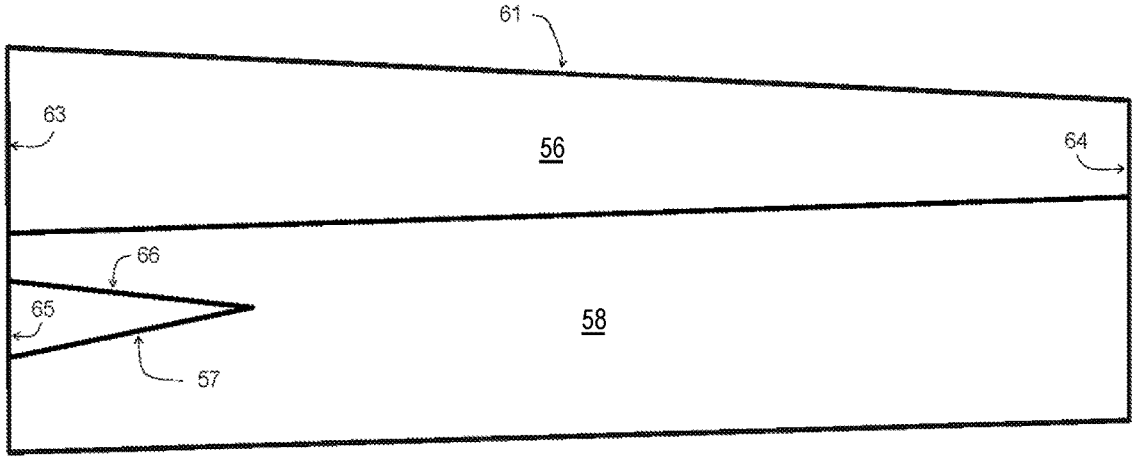
FIG. 7 shows a top view of a portion of an exemplary embodiment of a grooved micromesh decking.

FIG. 7 shows a top view of a portion of an exemplary embodiment of bridge portion having a groove 56, a crease 57, and section of the decking 58. Note, orifices in these elements are not shown for clarity. In various embodiments, all three of these elements may be made from the same piece of material. Further, as part of the micromesh decking 58, all three of these elements are also of the bridge portion. FIG. 7 shows that an area of a footprint of the groove 56 and an area of a footprint of the crease 57, as compared to a footprint of the area of the planar mesh 58 that is in-between adjacent grooves. In this embodiment, the grooves are considered to be irregular. As an example for this comparison, using sample values, the area of square inches in the three footprints are listed below.

The total area of the footprint of the groove 56 is approximately 0.831 square inches. This area is derived from [(((0.25"+0.13")*4.375")/2)], which are measurements of sides 63, 64 and 61.

The total area of the footprint of the crease 57 is approximately 0.065 square inches. This area is derived from [((0.13"*1")/2)], which are measurements of sides 65 and 66.

The total area of the footprint of the planar mesh 58 is approximately 1 square inch. This area is derived from [(0.242"*4.375")−((0.13"*1")/2)], which are measurements of sides 61 and 62 less the creased footprint area.

In summation, the planar area of mesh represents about 52.7% of the total footprint area of the three calculated areas above. This percentage of planar area of mesh with orifices is generally 50-70% greater than conventional corrugated mesh, whilst also being self-supporting. Moreover, as discussed further below, the varied elevations along properly configured grooves assist in debris drying and removal.

Table B shows ratios for determining higher percentages of planar areas of mesh decking between exemplary grooves, when the grooves are positioned farther apart from each other in order to support minimal weight. The calculations in Table B are based on using a 5.5 inch sized exemplary gutter guard device on a 5 inch size standard gutter. Each irregular groove represented in Table B has a footprint area of approximately 0.831 square inches. As the height of the irregular groove increases, the area of the crease increases.

TABLE B

| Distance Between Grooves | Footprint of Groove + Crease | Percent Footprint Area of Groove | Footprint Area Between Grooves | Percent Footprint Area Between Grooves |
|---|---|---|---|---|
| 0.242 inches | 0.831 $in^2$ + 0.065 $in^2$ = 0.896 $in^2$ | 47.3% | 1 $in^2$ | 52.7% |
| 0.604 inches | 0.831 $in^2$ + (0.065 $in^2$ * 1.2) = .0909 $in^2$ | 25.6% | 2.64 $in^2$ | 74.4% |
| 0.966 inches | 0.831 $in^2$ + (0.065 $in^2$ * 1.4) = 0.922 $in^2$ | 17.9% | 4.23 $in^2$ | 82.1% |
| 1.328 inches | 0.831 $in^2$ + (0.065 $in^2$ * 1.6) = 0.935 $in^2$ | 13.9% | 5.81 $in^2$ | 86.1% |
| 1.69 inches | 0.831 $in^2$ + (0.065 $in^2$ * 1.8) = 0.948 $in^2$ | 11.4% | 7.39 $in^2$ | 88.6% |
| 2.052 inches | 0.831 $in^2$ + (0.065 $in^2$ * 2) = 0.961 $in^2$ | 9.6% | 8.98 $in^2$ | 90.4% |
| 2.414 inches | 0.831 $in^2$ + (0.065 $in^2$ * 2.2) = 0.974 $in^2$ | 8.5% | 10.56 $in^2$ | 91.5% |

Figure 9:
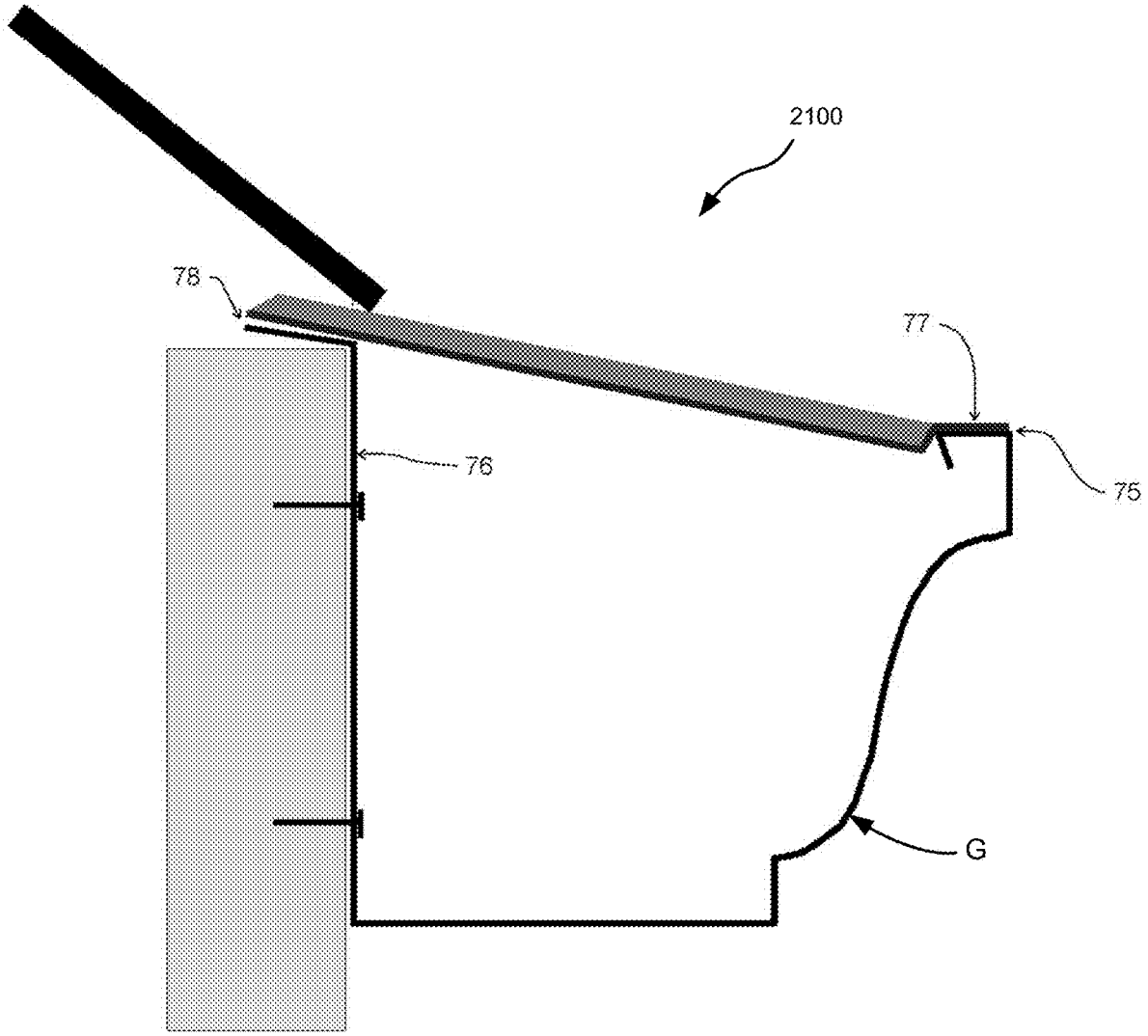
FIG. 9 shows an embodiment of an exemplary device installed over a gutter.

Another factor that will affect the distance between irregular grooves is the angle at which the exemplary gutter guard is installed on the gutter as shown, for example, in FIG. 9. Table C presents ratios for ratios for determining the ability to increase the distance between grooves on a standard 5-inch gutter, using a 5.5 inch sized exemplary gutter guard device with a surface area of mesh approximately 4.375 inches in width when installed in one of three optional angles. Sometimes it is necessary to have a more acute angle of installation of the exemplary gutter guard, depending on the configuration of how the gutter is installed along the facia and roofline and what type of roofing shingles are being used on the roof. The grooves of an exemplary device can be spaced farther apart on the decking of the bridge portion as the angle of installation increases and the height of the grooves can remain the same. The reason the distance can be larger, and the height remain steady, is because as the angle of installation (AI) increases, the front lip of the gutter as shown in FIG. 9, will be supporting more of the load of the device. One benefit of a steeply installed gutter guard is that debris more readily slides off and unto the ground.

TABLE C

| Groove Height | Distance Between Grooves | Angle of Installation (see FIG. 9) |
|---|---|---|
| 0.125 inches | 0.966 inches | 25 degrees |
| 0.125 inches | 1.69 inches | 45 degrees |
| 0.125 inches | 2.414 inches | 60 degrees |

Figure 8:
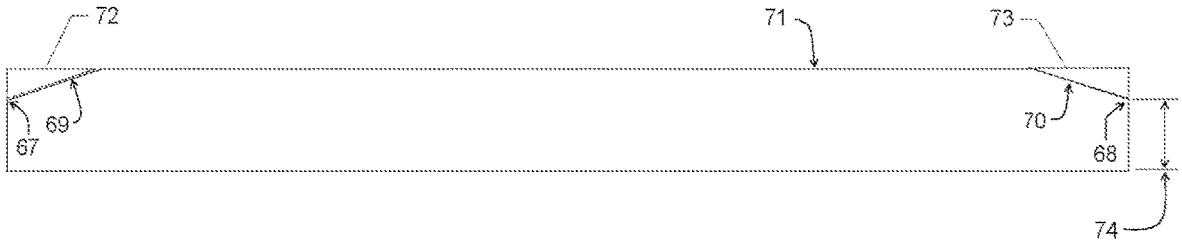
FIG. 8 shows a side view of exemplary micromesh decking, taken from the top view shown in FIG. 7.

FIG. 8 shows a side view of exemplary micromesh decking, taken from the top view shown in FIG. 7. Note, orifices in the decking are not shown for purposes of clarity. The decking has ends 67 and 68. These ends 67, 68 have upper sections that angle upwards at 69 and 70, respectively, to a top plane 71 of the decking. Areas 72 and 73 represent areas where there is no micromesh. This arrangement of the ends 67, 68 will cause the micromesh material, when inserted into the machine that forms the irregular grooves, to unevenly bend the micromesh and may cause it to buckle and deform. The creases, as shown and described in connection with FIG. 6, are designed at the proper length, width and height to provide additional micromesh to account for the area loss in areas 72 and 73. This arrangement will allow the micromesh to be formed without buckling or deformation in the bending machine during manufacturing.

Because the height of the top plane 71 in FIG. 8 (where the top chord bifurcates into two chords) is higher, it creates a stronger support for the planar areas of the micromesh decking. Increased irregular groove heights give the ability for the micromesh decking to increase in width for spanning wider gutters up to twelve inches or more. See Table D, which shows ratios for irregular groove height to irregular groove length for various gutter width sizes.

TABLE D

| Groove Height | Groove Length (includes length of front and rear beams) | Gutter Width |
|---|---|---|
| 0.125 inches | 5.5 inches | 5 inches |
| 0.163 inches | 6.5 inches | 6 inches |
| 0.201 inches | 7.5 inches | 7 inches |
| 0.239 inches | 8.5 inches | 8 inches |
| 0.277 inches | 9.5 inches | 9 inches |
| 0.315 inches | 10.5 inches | 10 inches |
| 0.353 inches | 11.5 inches | 11 inches |
| 0.391 inches | 12.5 inches | 12 inches |

As the gutter increases in width by one inch, the height of the irregular groove increases by 0.038 inches.

It will be appreciated that the height of the decking can also be planar from end 67 to end 68 without increasing in height. It will be appreciated that when height 74 is increased by design such that it begins to approach the same height 71, a crease, such as those shown in FIG. 6 may not be necessary at all. Further, it will be understood that as height 74 is increased, any height can be chosen, up to approximately 0.25 inches in some embodiments, wherein the grove will then need to be a bifurcated to accommodate the potential increased load capacity.

It will be appreciated that the grooves can be close or adjacent to each other and be positioned "opposite" or "reversed" from each other as shown in irregular grooves 12, 14, 16 and 18 which are opposite from grooves 13, 15, 17 and 19, as illustrated in FIG. 4. This alternating reversal of the grooves will help in the ridge bend manufacturing process in the mesh. By having irregular grooves positioned and oriented opposite of each other, when there is little to no height increase, creates an evenly balanced area of mesh for fabricating in a mesh-bending machine. Expressed in another way, the opposing arrangement operates to pair adjacent or neighboring grooves such that their "pair-reversed" geometries balance out the other's use or consumption of the mesh.

It will be appreciated that the grooves can be disposed in the decking of the bridge portion such that a groove rises above the top surface or in other embodiments, such that the groove is recessed below the bottom surface of the decking.

FIG. 9 shows an embodiment of an exemplary device 2100 installed over a gutter G. To assist with creating a strong anchor for the device 2100 to the gutter G, FIG. 9 shows the front lip of the gutter 75 and back of gutter 76 are acting as abutments for supporting the device 2100, similar to for example the spanned ends of a conventional bridge. The device 2100 can be fastened to the top 77 of the front lip of the gutter 75 by snapping in place, or with screws, or adhered to with double sided adhesive tape, glue or other fastening mechanisms. The back of the device 2100 can rest or be screwed into either the back of the gutter, fascia or plywood sheeting of the roof 78. It is noted that an optional "trough" can be implemented at the end of the bridge portion adjoining the front lip of the gutter.

Figure 11:
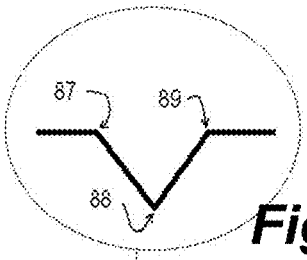
FIG. 11 is a blown-up view of Circle 11-11 in FIG. 10, showing an end profile groove.
Figure 10:
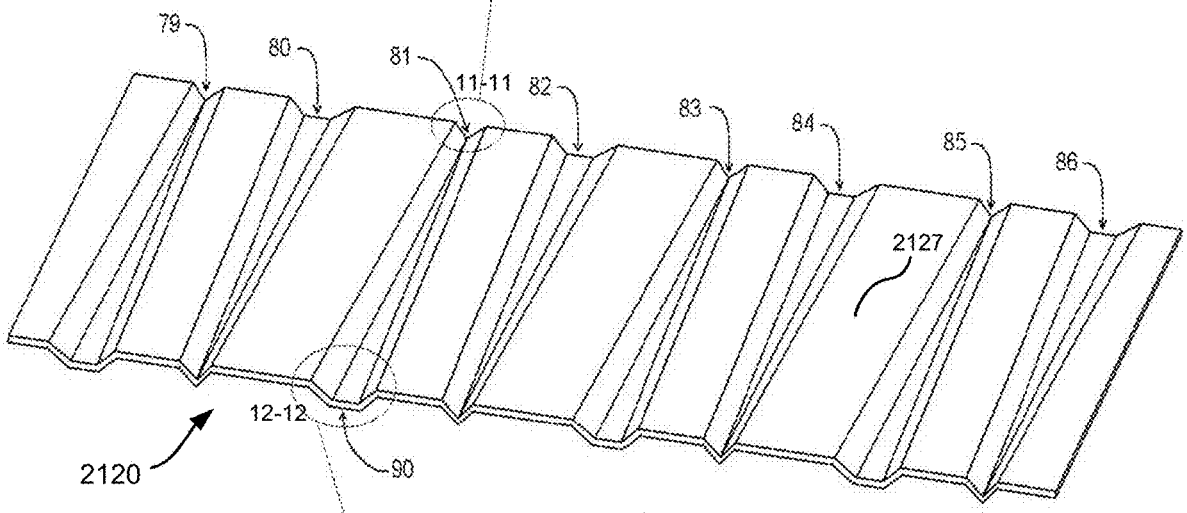
FIG. 10 shows a partial top perspective view of an alternative bridge portion having irregular grooves.
Figure 12:
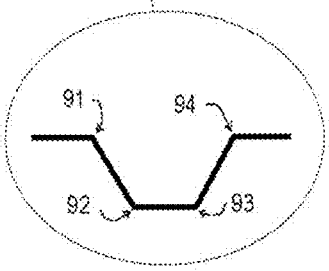
FIG. 12 is a blown-up view of Circle 12-12 in FIG. 10, showing a half hexagon groove profile.

FIG. 10 shows a partial top perspective view of an alternative bridge portion 2120, having irregular grooves 79, 80, 81, 82, 83, 84, 85 and 86 disposed in the decking 2127 of the bridge portion 2120. These grooves are disposed downward relative to the decking 2127, such that when the device is in use, the grooves are recessed or disposed toward the direction of the gutter opening. FIG. 11 is a blown-up view of Circle 11-11 showing an end profile groove 81 which has the shape of a "V," with corners 87, 88 and 89. The groove 81 at the opposing end of the bridge portion 2120 has a different profile shape. FIG. 12 is a blown-up view of Circle 12-12 showing the groove's profile at this end as a half hexagon 90, having corners 91, 92, 93 and 94.

FIG. 13 is a wide top partial perspective view of another exemplary bridge portion 2130, with irregular grooves. Note, orifices in decking of the bridge portion 2130 are not shown for purposes of clarity. The grooves are disposed upward (or bumped up) from the top surface of the decking, which is away from the gutter opening when the device is in use.

It should be noticed that in this and other Figs., the grooves vary the inclination or declination of the decking material, resulting in alternate sloping profiles for the bridge portion.

FIG. 14 is a top perspective close-up view of some of the irregular grooves illustrated in FIG. 13. Note, orifices in a decking 99 of the bridge portion 2130 are not shown for purposes of clarity. The leftmost groove in this Fig., groove 2132, has a front apex 96 at the front end 97 of the decking 99. The groove 2132 has a rear apex 95 on an opposing back end 98 of the decking 99. The groove 2132 has a front height dimension 102 measure at the front apex 96. The groove 2132 has a rear height dimension 103 measured at the rear apex 95. The front height dimension 102 is greater than the rear dimension 103, such that the groove slants downward from apex 96 to apex 95 in the direction of 100. An adjacent groove 2134 is shown as slanting in an opposing direction 101. It is understood that the bumped inverted V shape 104 and/or the bumped half-hexagon shape 105 of the grooves can, in other embodiments be any shaped polygon, irregular polygon or any non-straight shape such as a rounded arc, and so forth. Further the grooves can in other embodiments be recessed.

FIG. 15 is a top perspective close-up view of a alternative variation of the embodiment shown in FIG. 14. Specifically, FIG. 15 shows the irregular groove 2136 having a lower end 106 that is slanted downward from the opposite end and transition such that it "feathers" out into the planar level of the micromesh decking 107.

FIG. 16 is a wide top perspective view of another exemplary bridge portion 2140, having irregular grooves. Note, orifices in decking of the bridge portion 2140 are not shown for purposes of clarity. All of the grooves illustrated are disposed downward or recessed towards a gutter (not shown).

FIG. 17 shows a partial top perspective view of an exemplary bridge portion with irregular grooves 108, 109 and 110 that are downward facing. Note, orifices in decking of the bridge portion are not shown for purposes of clarity. Grooves 108, 109 and 110 are downward slanted irregular grooves.

FIG. 18 shows an alternative embodiment of an exemplary bridge portion 2150 having grooves 112, 113, 114, 115, 116, 117, 118 and 119. Note, orifices in the decking of the bridge portion 2150 are not shown for purposes of clarity. These grooves are irregular and are formed in sets on the decking 111. Sets of two grooves are closer together than the adjacent set of grooves. For example, irregular grooves 112 and 113 are closer together and separated by distance 120 forming a paired set, while being spaced at a further distance 121 from the neighboring paired set of grooves containing grooves 114 and 115. The distance 121 is greater than distance 120. It will be appreciated that the irregular grooves within a groove set can also be adjacent to each other to where there is very little, to practically no space between them. A groove set may contain two or more irregular grooves. One benefit of having groove sets on the micromesh decking, is that a set of two or more irregular grooves can provide for a wider distance between groove sets than individual irregular grooves placed in a non-set fashion. See Table E for example ratios for the distances between 0.125 inch in height sized irregular groove sets formed in micromesh decking on a 5.5 inch exemplary device as compared to individual irregular grooves in a non-set fashion.

Figure 19:
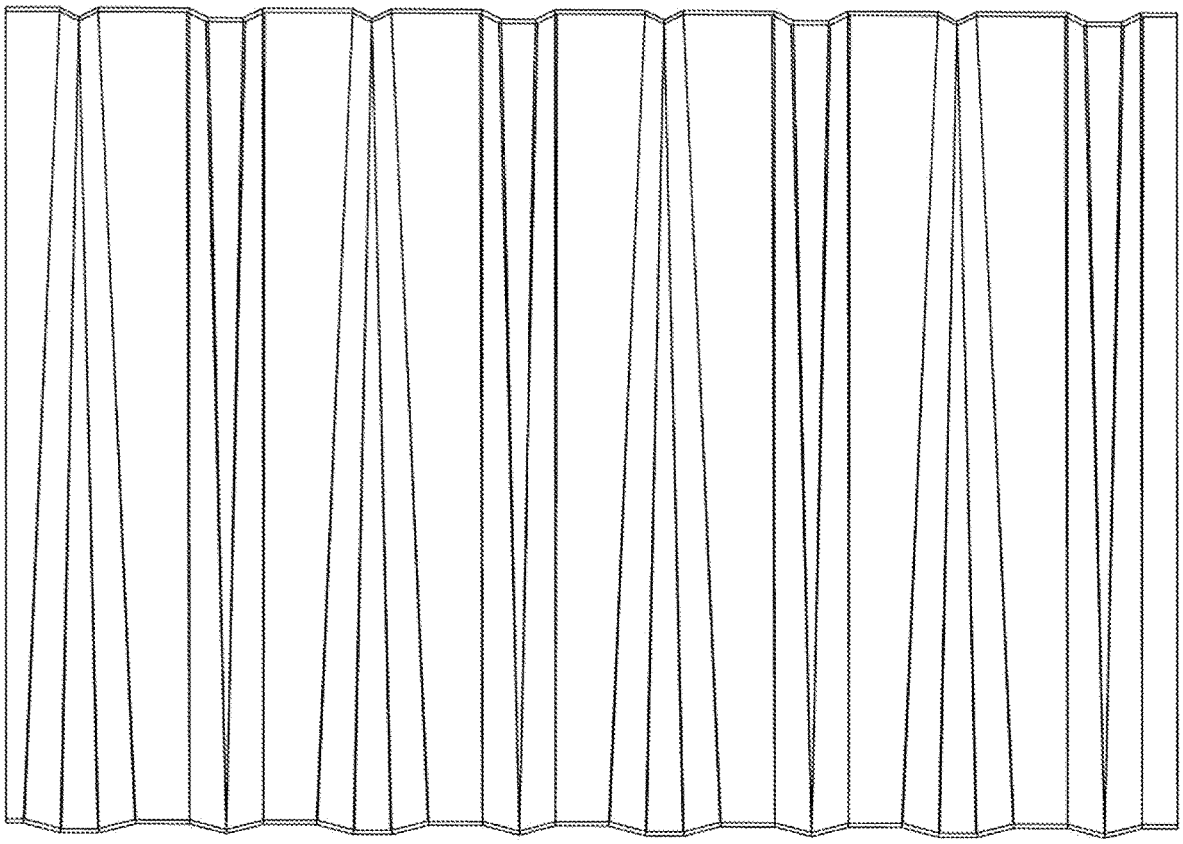
FIG. 19 is a wide top perspective view of another exemplary bridge portion, having irregular grooves

FIG. 19 is a wide top perspective view of another exemplary bridge portion, having irregular grooves. Note, orifices in decking of the bridge portion are not shown for purposes of clarity. The grooves illustrated include flared ramps.

Figure 20:
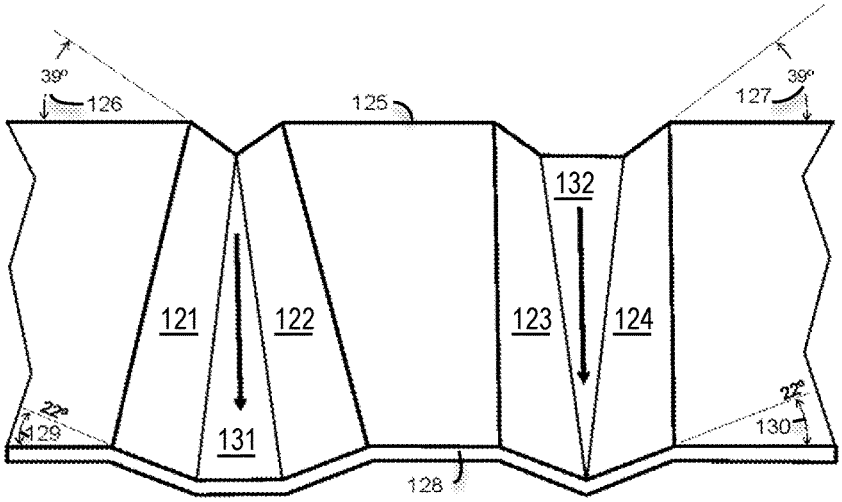
FIG. 20 is a closer view of the embodiment shown in FIG. 19.

FIG. 20 is a closer view of the embodiment shown in FIG. 19. The grooves include flared ramps 121 and 122 for one groove and ramps 123 and 124 for another adjacent groove. The flared ramps of the grooves enhance the overall ability of the device to enable debris to more freely move off the device. The ramps have angles relative to the decking material. Particularly, back angles 126 and 127 of the ramps 121, 122, 123 and 124, shown relative to a horizontal plane of the decking at the back 125 of the bridge portion. The back angles are more acute than front angles 129 and 130 of the same ramps relative to a horizontal plane of the decking at the front 128. Having flared out ramps towards the front of the micromesh decking 128 improves the self-cleaning attributes of the exemplary devices. Debris is more encouraged to slide off center surfaces 131 and 132, of the respective grooves, to the front of the micromesh decking 128 and off the gutter and unto the ground.

FIG. 21 is a wide top perspective view of another exemplary bridge portion, having irregular grooves. Note, orifices in decking 134 of the bridge portion are not shown for purposes of clarity. The grooves are disposed on the decking 134 such that all of them have wider openings (e.g., flared) all on one end of the decking 134.

FIG. 22 is a closeup view of the embodiment shown in FIG. 21. Two flared irregular grooves 2251, 2252 are shown having wider openings ends 135, 136, respectively, with a half hexagon shape facing the front 2228 of the micromesh decking 134. The irregular grooves 2251, 2252 are facing the same direction and are not positioned or oriented opposite each other. With this configuration of irregular grooves, the wider opening ends 135 and 136 are opposite back end 2225 having the smaller opening ends 137 and 138. The grooves 2251, 2252 each have angled ramps 139 and 140, and 141 and 142, respectively. Ramps 139, 140, 141 and 142 are flared out at the front 2228. This configuration of flared irregular grooves creates minimal resistance for debris to get stuck and encourages debris to travel off the device and on to the ground. Depending on the type of manufacturing equipment used for making this version of the flared irregular groove, a crease 143 may be needed as discussed in FIG. 6.

It will be appreciated that irregular grooves can be joined together to form various structures in the decking of the bridge portion, some which may be quasi parallel or ladder like.

Figure 23:
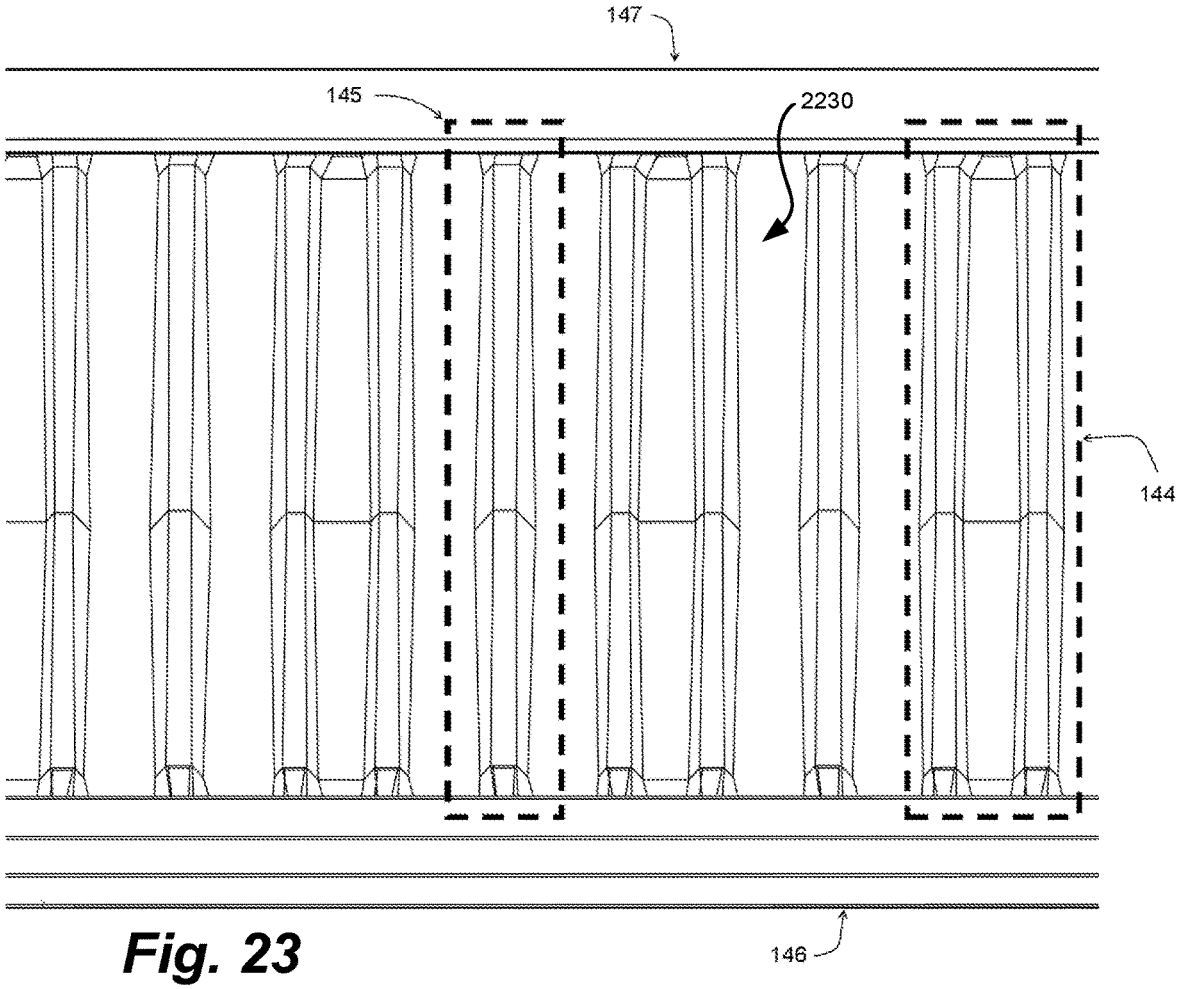
FIG. 23 is a wide top partial perspective view of another exemplary bridge portion with irregular grooves.

FIG. 23 is a wide top partial perspective view of another exemplary bridge portion 2320 with irregular grooves. Note, orifices in decking of the bridge portion 2320 are not shown for purposes of clarity. The bridge portion 2320 in this embodiment is considered to be super arched. The bridge portion includes at least one arched skyway 144 and at least one arched cambered section referred to here as a train of "segmented" grooves 145. The skyway 144 and the train of segmented grooves 145 can be formed into micromesh decking of the bridge portion 2320. The bridge portion 2320 is fastened to a front floor beam 146 at one end and to a back floor beam 147 at an opposing end. In this embodiment, there are a plurality of skyways 144 and a plurality of trains of segmented grooves 145. In this embodiment, all of the skyways 144 and trains of segmented grooves 145 and the planar micromesh decking are formed together from a single micromesh material, non-limiting examples being stainless steel and so forth. It should be appreciated that other materials can be utilized. The skyway and the train of segmented grooves preferably from the front edge of the bridge portion to the rear edge or vice versa. It will be appreciated that these structures may only extend partially across the bridge portion in some embodiments.

It will be understood that a train of segmented grooves is at least two irregular grooves joined together to form an elevated arched combined segmented groove. It will be further understood that a skyway includes at least two trains of segmented grooves sharing at least one rampway.

Figure 24:
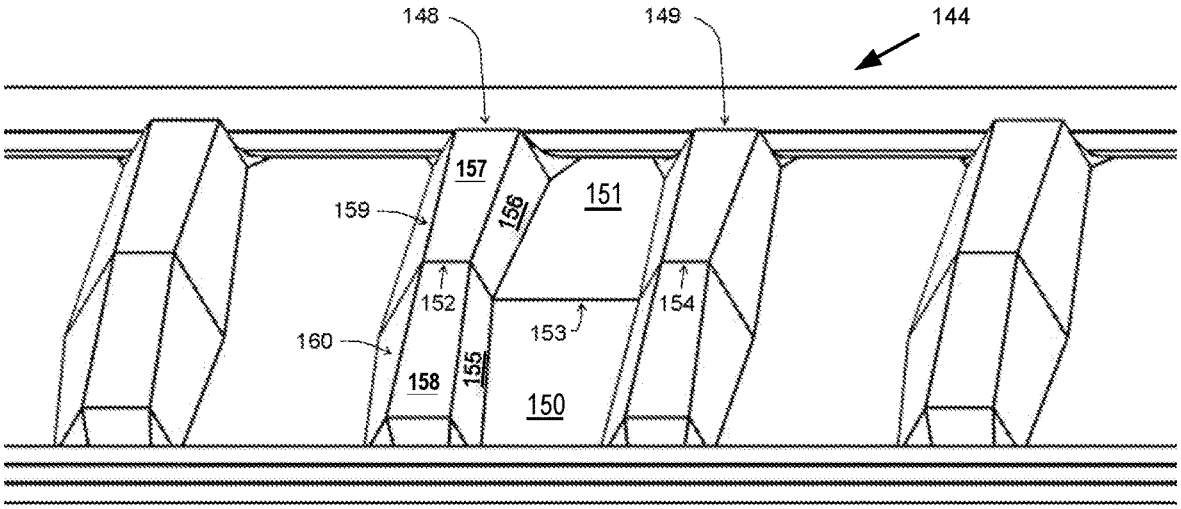
FIG. 24 is a closeup right partial perspective view of a skyway shown in FIG. 23.

FIG. 24 is a closeup right partial perspective view of a skyway 144 shown in FIG. 23. The skyway 144 shown here is illustrated as being composed of two "skyway" trains of segmented grooves 148 and 149, wherein the skyway trains 148 and 149 are connected to dual upward rampways 150 and 151. It is noted here that the segmented grooves in the skyways 144 are of similar form to the trains of segmented grooves 145 not in the skyway 144 (FIG. 23). Therefore, to distinguish the two forms of segmented grooves, the term "skyway train," in this embodiment and in other similar embodiments, will be used when discussing the segmented grooves within the skyway. Skyway train 148 of the skyway 144 also has three raised arches 152, 153 and 154. Skyway train 148 includes six interconnected panel portions 155, 156, 157, 158, 159 and 160, as shown. Skyway train 149 includes similar interconnected panel portions. The arch 152 is disposed between panels 160 and 159, panels 158 and 157, and panels 155 and 156. The arch 153 is disposed between rampways 150 and 151. Similar to skyway train 148, the arch 154 of skyway train 149 is disposed between similar panels. It will be appreciated that in other embodiments, a skyway can include more than two skyway trains.

Figure 25:
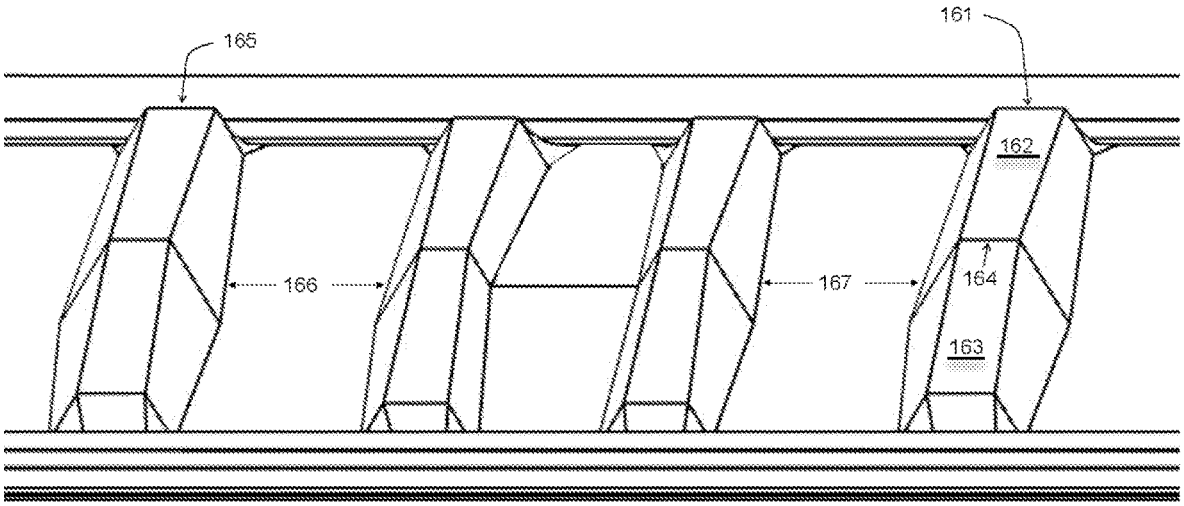
FIG. 25 is a closeup right partial perspective view of a skyway shown in FIG. 23.

FIG. 25 is a closer top right partial perspective view of the device shown in FIG. 23. For ease of reference in context of this embodiment and other similar embodiments, the term train of segmented grooves will be shorted to the term groove train. Detailed here is FIG. 23's groove train 145, with groove 161, which is seen as "larger" than the individual train of grooves found in the skyway trains of FIG. 24. Of course, the relative sizes may be altered according to design preference. Groove train 161 and its components is representative for the other groove trains on the device. Groove train 161 includes at least top ceiling surfaces 162 and 163. Ceiling surfaces 162 and 163 are angled up from the rear and front edges, respectively, toward the middle of the groove train 161 and are connected at the highest point, an apex 164. Oversized groove trains 161 and 165 are joined to a section of planar micromesh decking 166 and 167, respectively, which are then joined to a skyway 144 disposed between the groove trains 161 and 165.

Figure 26:
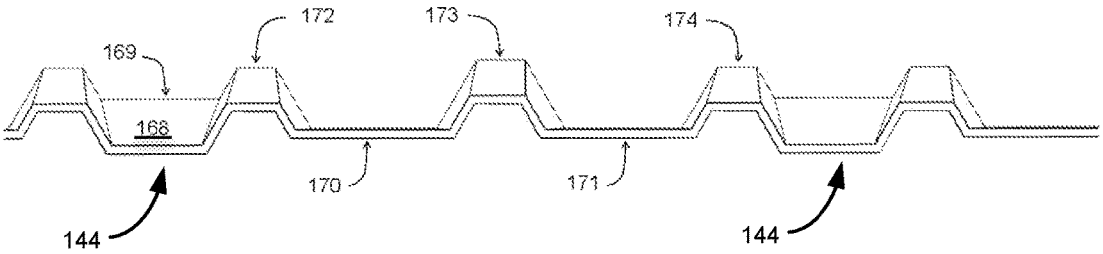
FIG. 26 is a partial front view of the structures of FIG. 25.

FIG. 26 is a partial front view of the structures defining the skyways and groove trains of FIG. 25. A skyway 144 has a rampway 168, which angles up to an apex 169. The apex 144 of rampways 168 are higher than the level of planar decking 170 and 171. The decking 170 and 171 is connected to and joins different skyway trains 172 and 174, as well as groove train 173. Groove train 173 is disposed between skyway trains 172 and 174.

Figure 27:
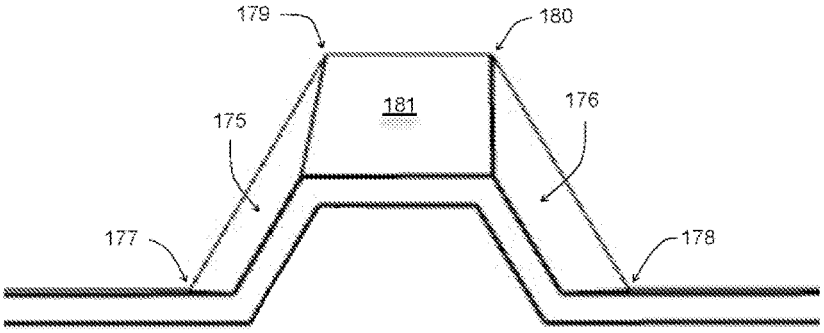
FIG. 27 shows partial front view of a single segmented grooves.

FIG. 27 shows partial front view of a single train of segmented grooves. All groove trains, including those connected to skyways, have outer supporting panels, 175 and 176. The panels have bases 177 and 178, respectively. The panes have apexes 179 and 180, respectively. The panels 175 and 176 are angled from the top, outwards away from a centerline of the groove train. This can be seen where bases 177 and 178 connect to the planar decking. The bases are further away from a centerline of the groove train than their apexes 179 and 180. These angled panels act as supports for keeping the groove trains from swaying, buckling or distorting. The outer groove train bases 177 and 178 act as anchors for securing panel apexes 179 and 180 from moving. An upper ceiling surface 181 of the groove trains, connects the panels 175 and 176 and holds them in place.

Figure 28:
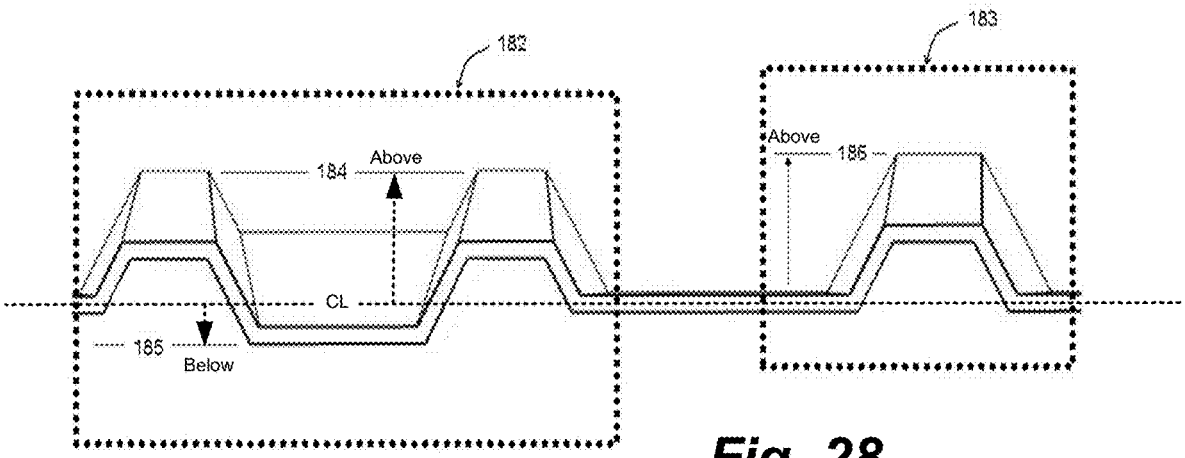
FIG. 28 is a closeup front profile partial view of an exemplary grooved bridge portion.

FIG. 28 is a closeup front profile partial view of an exemplary bridge portion having a micromesh decking, a skyway 182 and a groove train 183. The skyway 182 is a triple arched skyway structure having two "skyway" trains of segmented grooves (each with an arch) and arched section connecting the two skyway trains. The center line of the micromesh decking is represented by a dotted line CL. The center line CL is the horizontal center plane of the micromesh decking. The center line CL is the approximate plane as to that of the front lip of a gutter, when the device is in use. The skyway 182 is disposed such that it extends both, above, as shown by dimension 184, and below, as shown by dimension 185, this center line CL. The groove train 183 is disposed such that it extends above, as shown by dimension 186, the center line CL. Having segmented grooves that extend above and below the center-level CL, locked into the front and back floor beams, assists with improved strength and rigidity in the overall micromesh decking.

Figure 29:
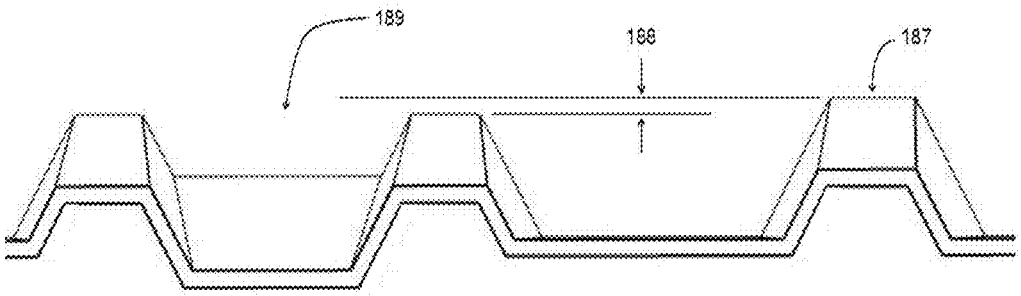
FIG. 29 shows is a closeup front profile partial view of a grooved bridge portion.

FIG. 29 shows is a closeup front profile partial view of a bridge portion having a micromesh decking, a single arched groove train 187 and a triple arched skyway 189. The height of the groove train 187 is slighter taller relative to the micromesh decking than the height of the skyway 189, as shown by dimension 188. The uneven height of these arches, as well as the rampways and planar decking, creates more opportunities for debris to be raised and lifted up for leaves and pine needles to be blown off the roof than if the heights were even.

Figure 30:
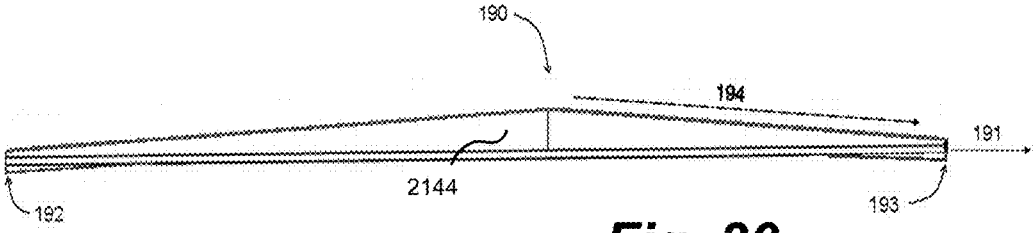
FIG. 30 is a side view of an exemplary bridge portion having a micromesh decking.

FIG. 30 is a side view of an exemplary bridge portion having a micromesh decking 2144. The decking 2144 has a center line 191, which represents a center plane of the decking 2144. The decking includes skyway trains having an apex 190. The decking includes a skyway having rampways with bases 192 and 193. The apex 190 is disposed above the center line 191. The bases 192 and 193 of the rampways are disposed below the center line 191. It will be appreciated that the apexes of a skyway trains can be positioned at any point along the lateral ceiling and not just in the location 190 as shown in FIG. 30. The downward slope 194 of the skyway train ceilings which are disposed towards the front of a gutter, away from the roof, encourages leaves and pine needles to slide off the front lip of the gutter and to the ground below.

Figure 31:
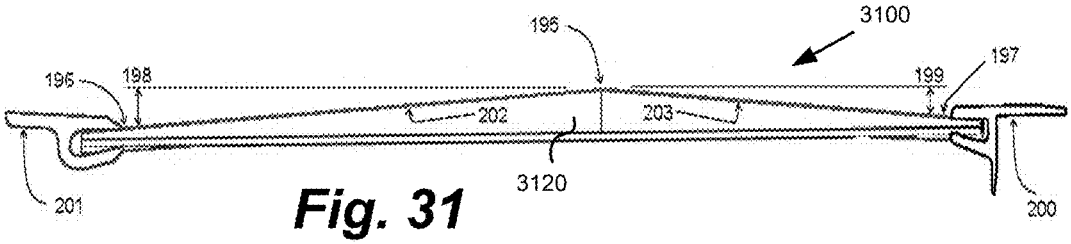
FIG. 31 shows a cross-sectional lateral view of an exemplary device.

FIG. 31 shows a cross-sectional lateral view of an exemplary device 3100. The device 3100 includes a gutter attachment member 200, a roof attachment member 201 and a bridge member 3120 disposed between the roof attachment 201 and gutter attachment 200 members. The gutter attachment member 200 is a front floor beam. The roof attachment member 201 is understood to operate as a rear floor beam. The bridge member 3120 includes micromesh decking. The bridge member 3120 includes at least one skyway, such as the skyways disclosed herein, and at least one segmented groove, such as the segmented grooves disclosed herein. The segmented groove has ceilings 202 and 203. The segmented groove also includes an apex peak 195, and ceiling base ends 196 and 197 adjacent the roof attachment member 201 and the gutter attachment member 200, respectively. The apex peak 195 has a greater dimension from the center plane of the decking (see FIG. 30, for example) than the ceiling base ends 196 and 197. Having the decking attached into the front floor beam 200 and the rear floor beam 201 creates a significant strengthened support structure against loads on the device, such as leaves, pine needles and other debris. It will be appreciated, that the higher the apex peak 195 is disposed above the ceiling base ends 196 and 197, which makes the camber ceilings 202 and 203 less horizontal, the more downward force (i.e. load) the skyways, segmented grooves, rampways and planar decking can sustain.

Figure 32:
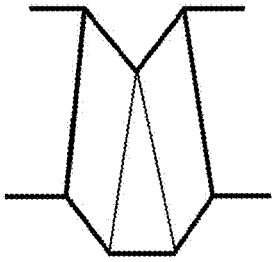
FIG. 32 shows a view of a groove profile shape transition along its length from a half hexagon profile to a triangle profile.
Figure 33:
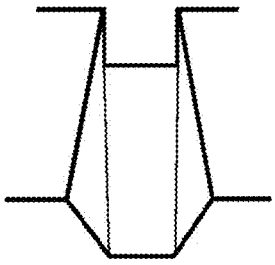
FIG. 33 shows a view of a groove profile shape transition along its length from a half hexagon profile to a box profile.
Figure 34:
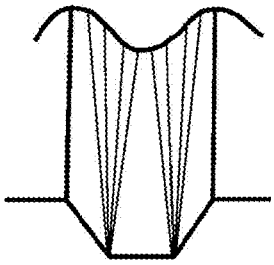
FIG. 34 shows a view of a groove profile shape transition along its length from a half hexagon profile to a sinusoidal profile.
Figure 35:
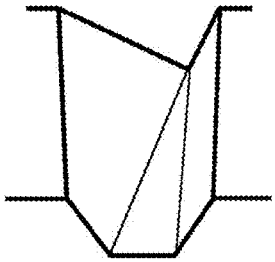
FIG. 35 shows a view of a groove profile shape transition along its length from a half hexagon profile to an off center profile.
Figure 36:
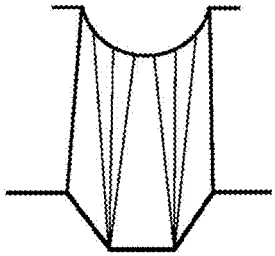
FIG. 36 shows a view of a groove profile shape transition along its length from a half hexagon profile to a dip profile.

FIGS. 32, 33, 34, 35 and 36 display views of various examples of profiles that the grooves may have for alternative embodiments. Particularly, these profiles change their geometry along the length of the groove. FIG. 32 shows a groove profile shape transition along its length from a half hexagon profile to a triangle profile. FIG. 33 shows a groove profile shape transition along its length from a half hexagon profile to a box profile. FIG. 34 shows a groove profile shape transition along its length from a half hexagon profile to a sinusoidal profile. FIG. 35 shows a groove profile shape transition along its length from a half hexagon profile to a off center profile. FIG. 36 shows a groove profile shape transition along its length from a half hexagon profile to a dip profile.

Figure 37:
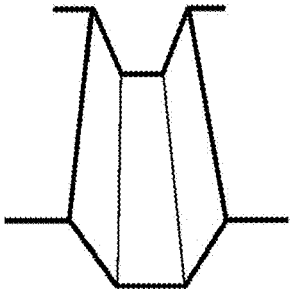
FIG. 37 shows a view of a groove profile shape transition along its length from a half hexagon profile to a smaller dimension half hexagon profile.
Figure 38:
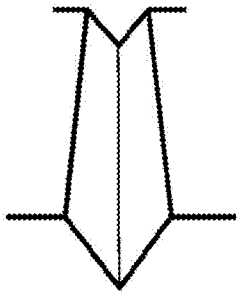
FIG. 38 shows a view of a groove profile shape transition along its length from a large V profile to a smaller V profile.
Figure 39:
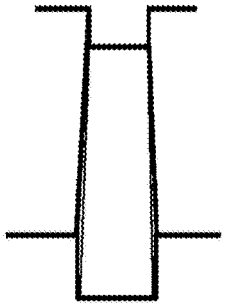
FIG. 39 shows a view of a groove profile shape transition along its length from a large box to a small box profile.
Figure 40:
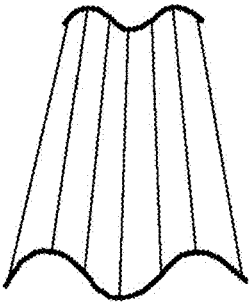
FIG. 40 shows a view of a groove profile shape transition along its length from a large sinusoidal to a small sinusoidal profile.
Figure 41:
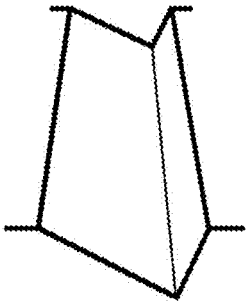
FIG. 41 shows a view of a groove profile shape transition along its length from a large off-center profile to a small off-center profile.
Figure 42:
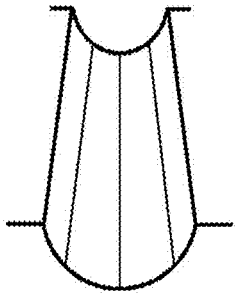
FIG. 42 shows a view of a groove profile shape transition along its length from a large dome profile to a small dip profile.

FIGS. 37, 38, 39, 40, 41, and 42 display views of various alternative embodiments of profile for the exemplary grooves. Particularly, these profile shapes of the grooves change their size along the length of the groove. FIG. 37 shows a groove profile shape transition along its length from a half hexagon profile to a smaller dimension half hexagon profile. FIG. 38 shows a groove profile shape transition along its length from a large V profile to a smaller V profile. FIG. 39 shows a groove profile shape transition along its length from a large box to a small box profile. FIG. 40 shows a groove profile shape transition along its length from a large sinusoidal to a small sinusoidal profile. FIG. 41 shows a groove profile shape transition along its length from a large off-center profile to a small off-center profile. FIG. 42 shows a groove profile shape transition along its length from a large dome profile to a small dip profile.

Figure 43:
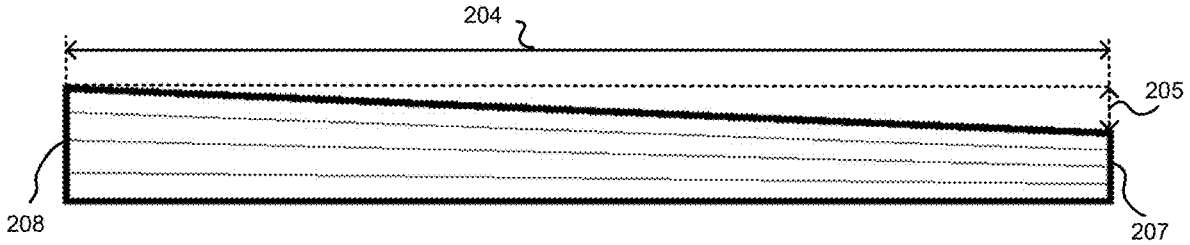
FIG. 43 shows a side view of the exemplary groove embodiment shown in FIG. 40.

FIG. 43 shows a cross-sectional view of the exemplary groove embodiment shown in FIG. 40. In this Fig. it can be seen that the lateral apex 204 of the diminishing irregular groove slants down from back edge 206 to the front edge 207. The ends of the lateral apex 204 is diminished by a height of dimension 205. A benefit of diminishing irregular grooves is it enables debris to more readily slide off the device.

Figure 44:
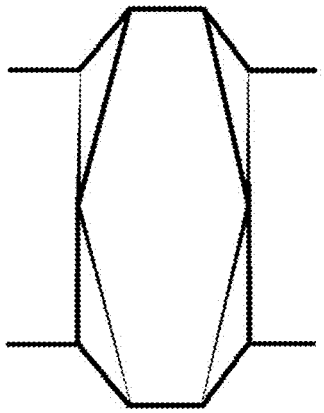
FIG. 44 shows a view of a groove profile shape transition along its length from a half hexagon profile to nothing and then back to a half hexagon profile.
Figure 45:
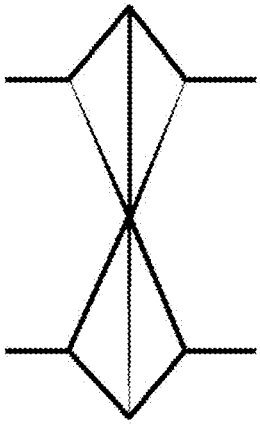
FIG. 45 shows a view of a groove profile shape transition along its length from a V profile to nothing and back to a V profile.
Figure 46:
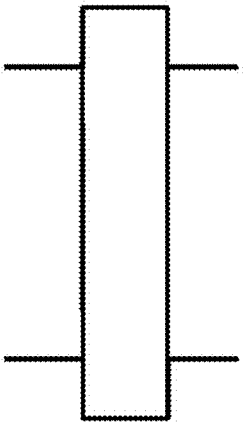
FIG. 46 shows a view of a box shape along the entire length of the groove.
Figure 47:
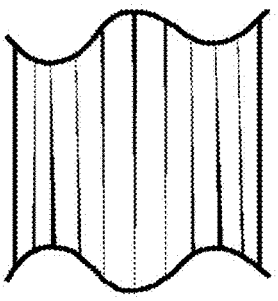
FIG. 47 shows a view of a groove profile shape transition along its length from a sinusoidal to nothing and back to sinusoidal.
Figure 48:
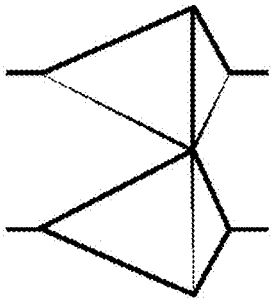
FIG. 48 shows a view of a groove profile shape transition along its length from an off-center profile to nothing and back to an off-center profile.
Figure 49:
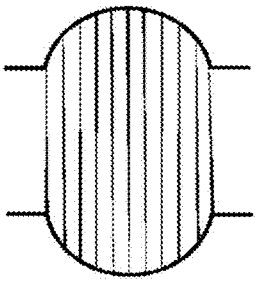
FIG. 49 shows a view of a groove profile shape transition along its length from a recessed dip profile to nothing and back to a bumped dip profile.

FIGS. 44, 45, 46, 47, 48 and 49 display views of alternate geometries possible for embodiments of the exemplary grooves. Most of the profile shapes of the grooves are considered as irregular or geometric, some having a changing profile along the length of the groove. FIG. 44 shows a groove profile shape transition along its length from a half hexagon profile to nothing and then back to a half hexagon profile. FIG. 45 shows a groove profile shape transition along its length from a V profile to nothing and back to a V profile. FIG. 46 shows a box shape along the entire length of the groove. FIG. 47 shows a groove profile shape transition along its length from a sinusoidal to nothing and back to sinusoidal. FIG. 48 shows a groove profile shape transition along its length from an off-center profile to nothing and back to an off-center profile. FIG. 49 shows a groove profile shape transition along its length from a recessed dip profile to nothing and back to a bumped dip profile. It should be noted that while the above FIGS. illustrate a "symmetry" in the transitions of the groove shapes or geometry, non-symmetric configurations may be implemented.

Figure 50:
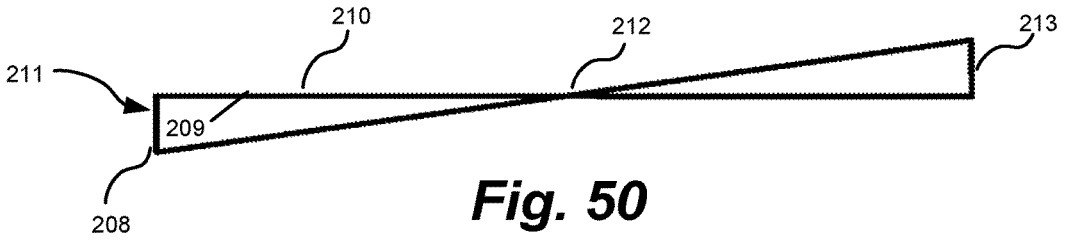
FIG. 50 is a cross-sectional side view of a transitional half hexagon shaped irregular groove.

FIG. 50 is a cross-sectional sideview of a half hexagon shaped irregular groove 208, wherein the groove 208 starts on the underside 209 of planar surface 210 of the decking on the front side 211, then travels to an intersecting point 212 which is half way between both sides of where the irregular groove 208 diminishes into a planar form. The groove length, then extends from the intersecting point 212 to the rear side 213, wherein it forms the shape of a half hexagon again and the shape is now reversed 180 degrees from its original perspective. At the intersecting point 212, the shape of the groove is planar.

Figure 51:
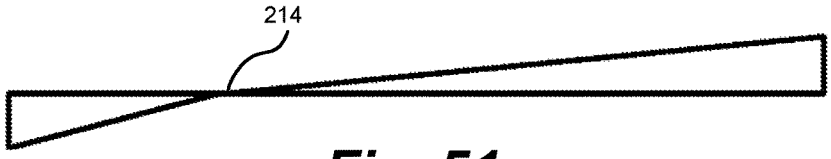
FIG. 51 shows the embodiment of FIG. 50 with its intersecting point displaced from a midpoint.
Figure 52:
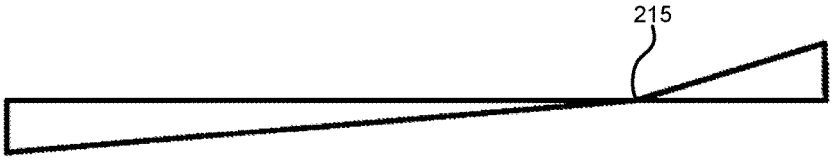
FIG. 52 shows the embodiment of FIG. 50 with its intersecting point displaced on another side of the midpoint.

It will be appreciated that the intersecting point can be in different positions along the X-axis (see for example, FIG. 53), transversely between the front and back longitudinally Z-axis. FIG. 51 for example, shows the intersecting point 214 farther left of the middle of the groove along the X-axis. FIG. 52 shows another example wherein the intersecting point 215 is farther right of the middle of the groove. Varying the intersecting points from one irregular groove to another adjacent irregular groove provides additional integrity of the micromesh decking.

Figure 53:
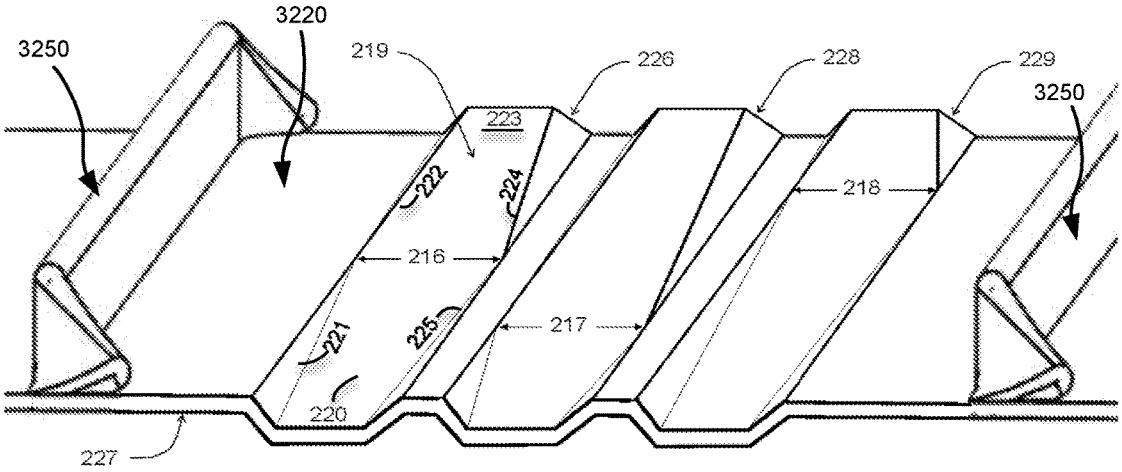
FIG. 53 shows a partial perspective view of an alternative embodiment of an exemplary bridge portion.

FIG. 53 shows a partial perspective view of an alternative embodiment of an exemplary bridge portion 3220 with an optional trusses 3250. Note for clarity, the orifices in the decking of the bridge portion 3320 are not shown. This bridge portion 3220 includes three half hexagon irregular grooves 226, 228 and 229 with different intersecting points 216, 217 and 218, respectively. These three grooves correspond to the grooves shown in FIGS. 50, 51 and 52, respectively. The groove 226 in the decking plane 219 includes a six-sided 220, 221, 222, 223, 224 and 225 irregular polygon shaped base. This base of the irregular groove 226 is slanted laterally towards the front 227, which when in use would be toward the gutter lip. This configuration further helps in allowing leaves and pine needles to slide off the gutter and onto the ground. All three irregular grooves 226, 228 and 229 start out along their respective lengths with the half hexagon shape and end with the half hexagon shape. It will be appreciated that although the starting and ending of the irregular grooves 226, 228 and 229 are the shape of the half hexagon, they can by design transition into any other shape at the other end of their respective lengths, such as a triangle, box, sinusoidal, off center, dip or other shape, such as but not limited to the shapes shown in FIGS. 32-36. Further, in FIG. 53, all three irregular grooves 226, 228 and 229 start out along their lengths with the half hexagon shape and end with the same sized half hexagon shape at the respective opposing end. It will however be appreciated that the grooves can transition to smaller sizes, such as but not limited to the examples shown in FIGS. 37-42.

FIG. 54 displays a bottom, front perspective view of a portion of an alternative embodiment of an exemplary bridge portion. For purposes of clarity the orifices in the decking 233 of the bridge portion are not shown. In this embodiment, the at least one groove is three grooves 230, 231 and 232. These grooves 230, 231 and 232 are irregular in their respective shapes. The grooves 230, 231 and 232 are formed above, below and above the decking 233, respectively. Each of the grooves 230, 231 and 232 has a planar apex surface 235, 234, and 236, respectively. The spacing between these irregular grooves can be varied in other embodiments. For illustration, these grooves can be bifurcated, as shown with groove 231. The groove 231 has a bottom chord 237, which bifurcates to two secondary chords 238 and 239.

Figure 60:
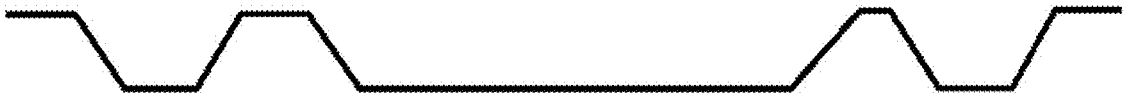
FIG. 60 illustrates a rear view of a bridge portion having irregular grooves with varying groove widths.
Figure 61:
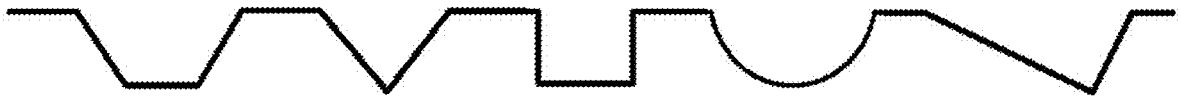
FIG. 61 illustrates a rear view of a bridge portion having irregular grooves with varying groove shapes.
Figure 62:
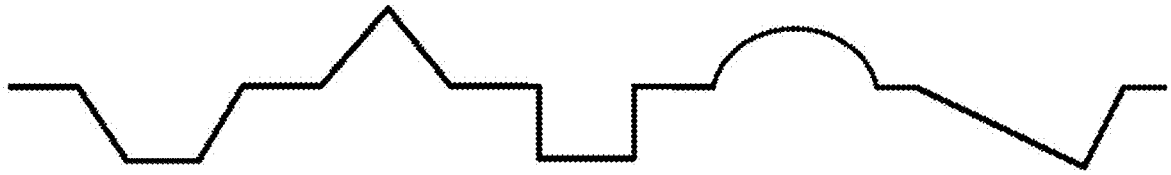
FIG. 62 illustrates a rear view of a bridge portion having irregular grooves with cross plane varying groove shapes.
Figure 63:
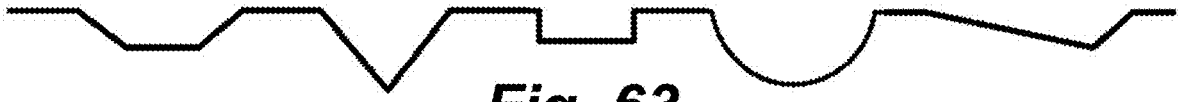
FIG. 63 illustrates a rear view of a bridge portion having irregular grooves with varying groove shape and groove heights.
Figure 64:
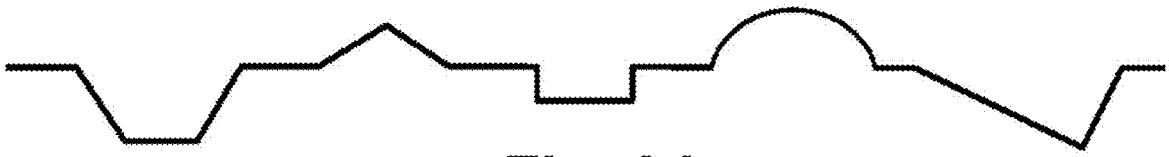
FIG. 64 illustrates a rear view of a bridge portion having irregular grooves with cross plane varying groove shapes and groove heights.

FIGS. 55, 56, 57, 58, 59, 60, 61, 62, 63 and 64 display front profile views of examples of various groove arrangements for alternative embodiments of an exemplary bridge portion. For example, FIG. 55 illustrates a bridge portion having a plurality alternating irregular grooves. FIG. 56 illustrates a bridge portion having a plurality downward irregular grooves. FIG. 57 illustrates a bridge portion having a plurality upward irregular grooves. FIG. 58 illustrates a bridge portion having a plurality of cross plane irregular grooves. FIG. 59 illustrates a bridge portion having a plurality of irregular grooves with varying groove heights. FIG. 60 illustrates a bridge portion having irregular grooves with varying groove widths. FIG. 61 illustrates a bridge portion having irregular grooves with varying groove shapes. FIG. 62 illustrates a bridge portion having irregular grooves with cross plane varying groove shapes. FIG. 63 illustrates a bridge portion having irregular grooves with varying groove shape and groove heights. FIG. 64 illustrates a bridge portion having irregular grooves with cross plane varying groove shapes and groove heights.

Figure 65:
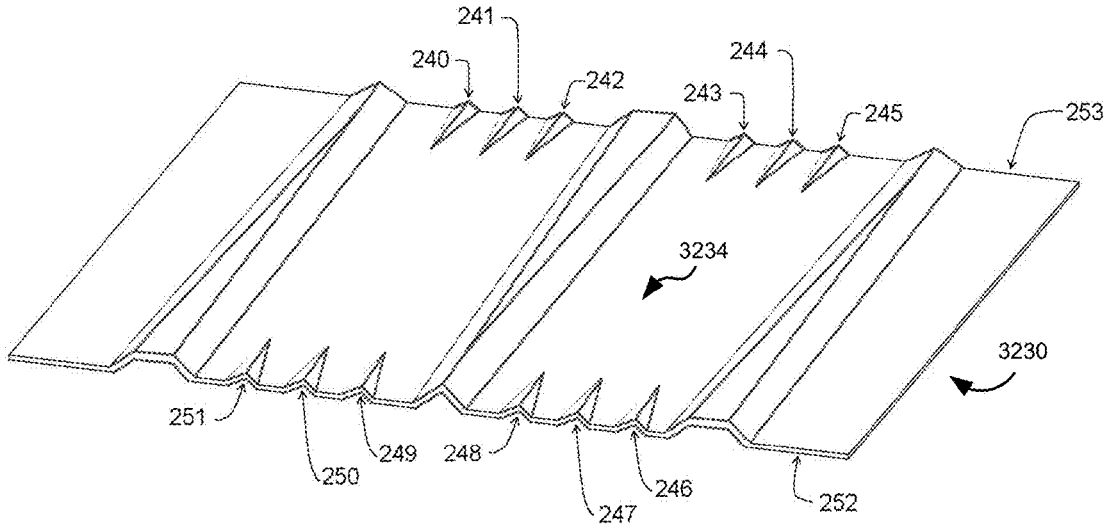
FIG. 65 illustrates a perspective view of an alternative embodiment of an exemplary bridge portion.

FIG. 65 illustrates a profile view of an alternative embodiment of an exemplary bridge portion 3230. The decking 3234 of the bridge portion 3230 of this embodiment includes at least one crease. A plurality of orifices in the decking of the bridge portion 3230 are not shown in this Fig. for purposes of clarity. This embodiment has several creases 240, 241, 242, 243, 244, 245, 246, 247, 248, 249, 250, and 251. Some of the creases are disposed along the longitudinal front 252 and some along the back 253 of the decking 3234. This arrangement will allow for the receiving centers of the floor beams (the gutter attachment and roof attachment portions), not shown, to have better ability to fasten to the bridge portion 3230. Additionally, the creases create a more aesthetic appearance. The creases, or wrinkles, extend beyond the floor beams and into the micromesh decking 3234 that is exposed to the exterior weathering elements, which benefits the device by providing additional strength to support in tandem with trusses, if used. It will be appreciated that the creases do not have to begin at the edge of the longitudinal front 252 or rear 253, they can begin at the exposed front and back floor beams. In this configuration, the creases would be adjacent to the floor beams but not inside the floor beams (not shown).

Figure 66:
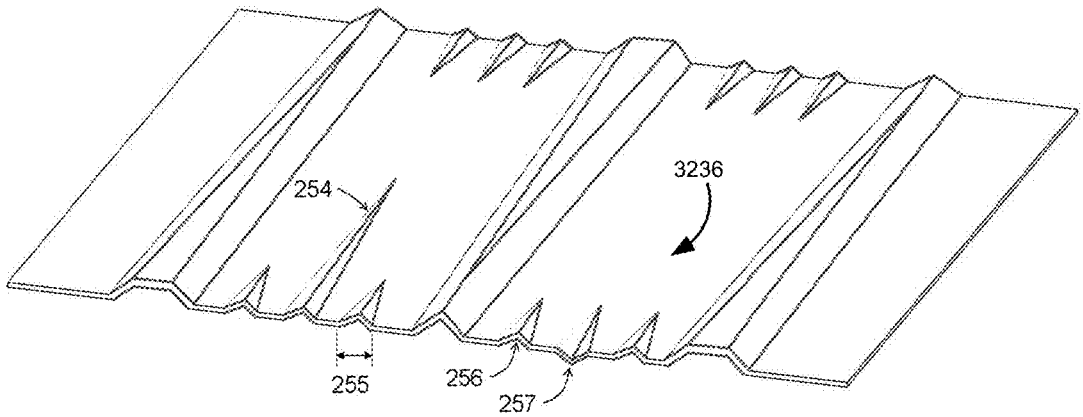
FIG. 66 illustrates a perspective view showing that the creases on the same device can have different, varying lengths, widths and be formed upwards or downwards in the decking.

FIG. 66 illustrates that the creases on the same device can have different, varying lengths 254, varying widths 255 and be formed upwards 256 in the decking or downwards 257 in the decking 3236. The starting shape of the crease can be that of variety of shapes, such as but not limited to a half hexagon, triangle, box, sinusoidal, off center, dip or other shape. The shapes of the creases then transition into the planar surface of the mesh decking 3236.

The gutter attachment portion (front floor beam) and the roof attachment portion (back floor beam) can in various embodiments be connected to the bridge portion through a variety of optional methods including, but not limited to, crimping, riveting, gluing or other form of adhesive in order to lock them together. The gutter attachment and roof attachment portions may be designed to further enable the locking or securing of the bridge portion thereto. Examples of which are presented hereafter. The floor beams can be formed into different shapes and made from a variety of materials including aluminum, steel, any type plastic, etc.

Figure 67:
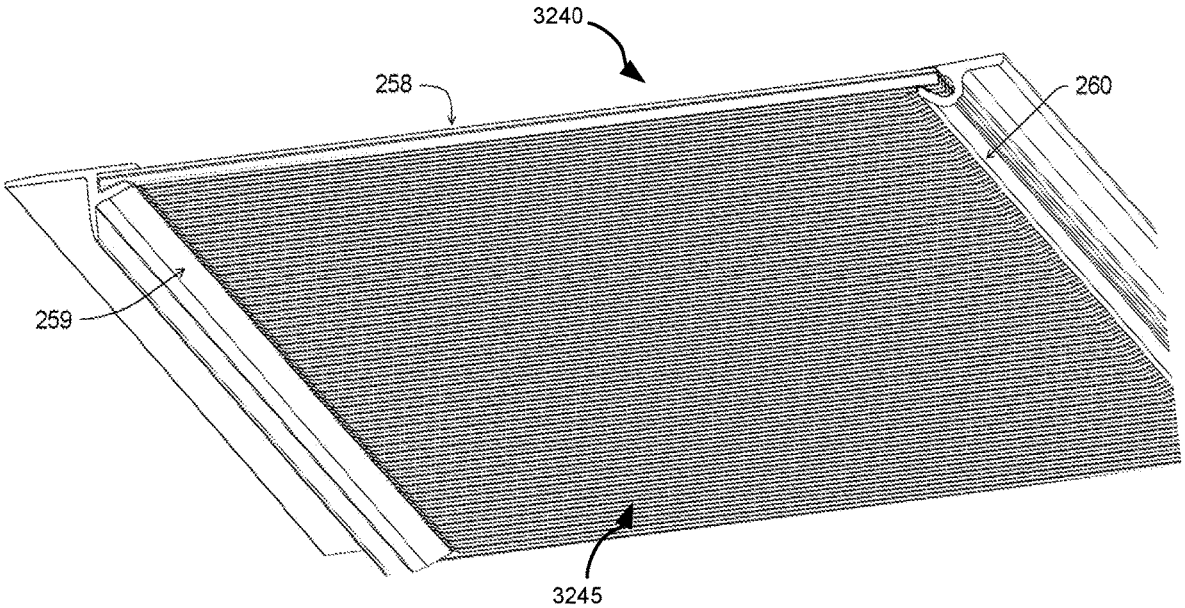
FIG. 67 shows a right side, bottom partial perspective view of an exemplary device.

FIG. 67 shows a right, bottom partial perspective view of an exemplary device 3240. The exemplary device 3240 includes a micromesh decking 258 disposed between a front floor beam 259 and a back floor beam 260. The decking 258 includes a plurality of grooves 3245. The micromesh decking 258 is attached inside the front and back floor beams 259 and 260, respectively. The floor beams can be closed tightly on the micromesh decking 258 through a variety of optional manufacturing methods including, but not limited to, crimping, riveting, gluing or other form of adhesive in order to lock the irregular groove ends and flat decked micromesh in place. It will be appreciated that the floor beams can be made from extruded aluminum and formed into different shapes other than what is shown in FIG. 67. Further, the floor beams can also be made from aluminum sheet, aluminum coil rolls, steel sheet, steel coil rolls or other metal coil roll or sheet types, and so forth.

Figure 68:
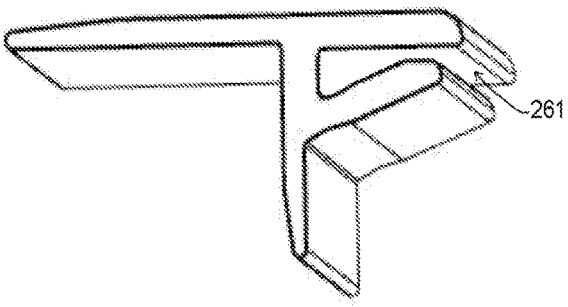
FIG. 68 is a closeup of an exemplary front floor beam showing an embodiment of a receiving center.
Figure 69:
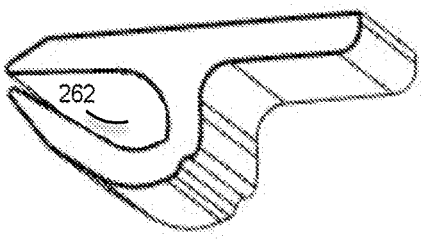

FIGS. 68 and 69 show partial side perspective views of exemplary front and back floor beams. FIG. 68 is a closeup of an exemplary front floor beam showing a receiving center 261 whereby the micromesh decking (not shown) is inserted for attachment. FIG. 69 is a closeup of an exemplary back floor beam showing the receiving center 262 whereby the micromesh decking (not shown) is inserted for attachment.

Figure 70:
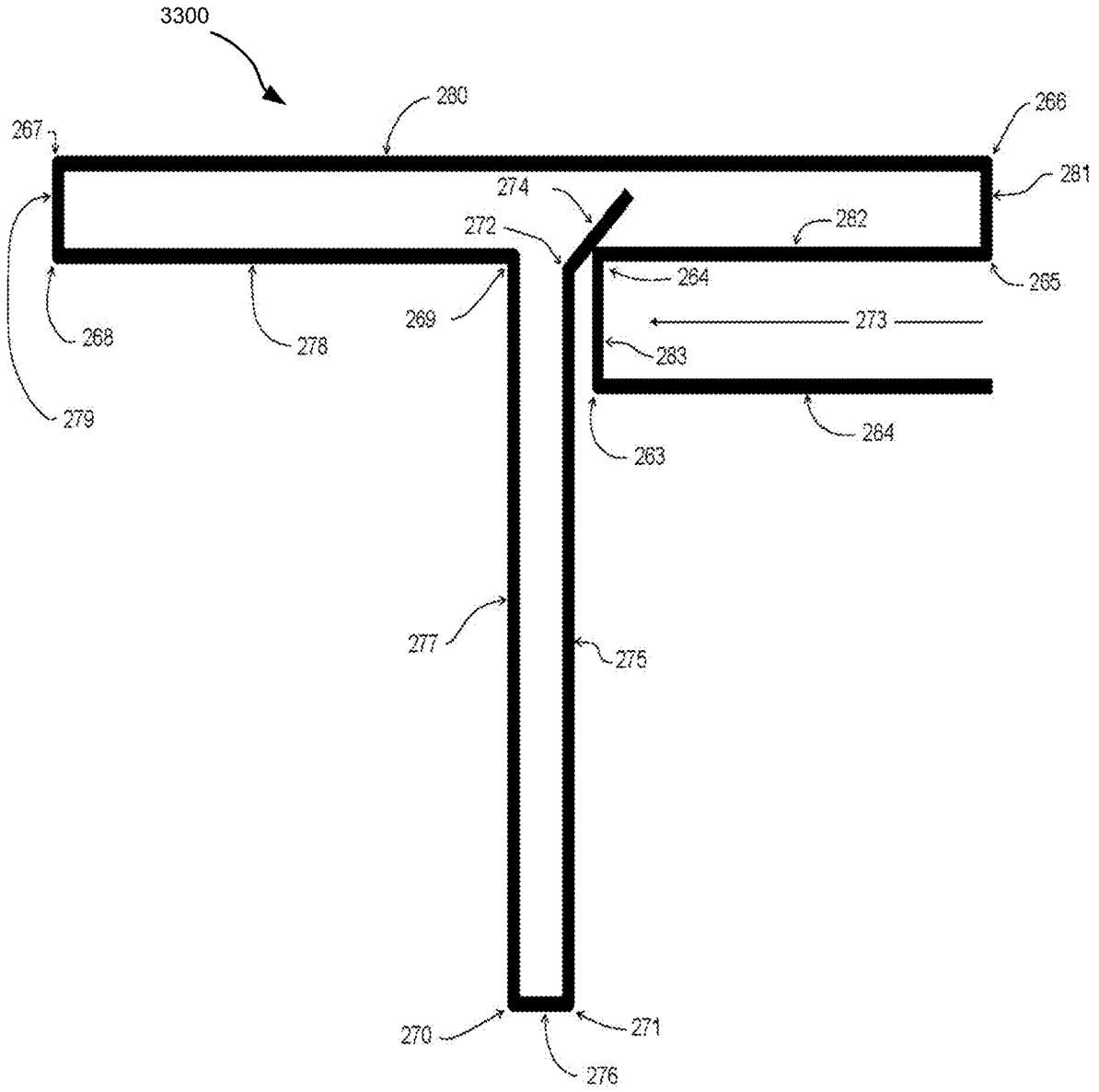
FIG. 70 shows a side cross sectional view of an exemplary front floor beam applicable for use with embodiments of an exemplary device.

FIG. 70 shows a side view of an exemplary front floor beam 3300 applicable for use with embodiments of an exemplary device(s). Front floor beam 3300 is shown with ten "corners" 263, 264, 265, 266, 267, 268, 269, 270, 271 and 272. It will be appreciated that other embodiments may be made with more or less than ten corners and that the corners may have different angles than shown. The receiving center 273 is where the decking (not shown) and optional trusses (or girders) are inserted and then later closed shut in the manufacturing process to firmly anchor the decking. An angled tab 274 is bent towards corner 264 for being locked in place. When the angled tab is locked into place, it stiffens and strengthens one or more of the floor beam surfaces 275-284. An open space is between the floor beam surfaces 275-284. However, it will be appreciated that there would be little to no space between these surfaces in a produced beam, depending on the manufacturing process. The open space in this diagram is to better show the attributes and purpose of the surfaces and their interaction with each other. It will be further appreciated that in other embodiments, the interior of all floor beam surfaces 275-284 can have an applied adhesive, glue, foam, injectant, material or other type of adherent to assist in helping the surfaces retain rigidity over time. In addition to just closing shut the receiving center 273 surface 284 against upper surface 282, an adhesive or glue, foam, injectant, material or other type adherent can be applied on a portion of or all of surfaces 282, 283 and 284 on the inner side of the receiving center 273 prior to inserting the decking material. This would provide additional locking forces to anchor the decking material in the receiving center 273.

Figure 71:
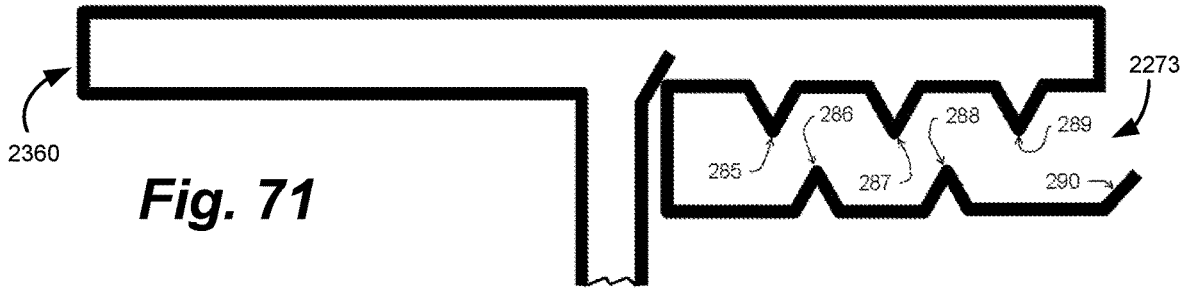
FIG. 71 shows a cross sectional view of an alternative embodiment of a front receiving center with triangle shaped teeth.
Figure 72:
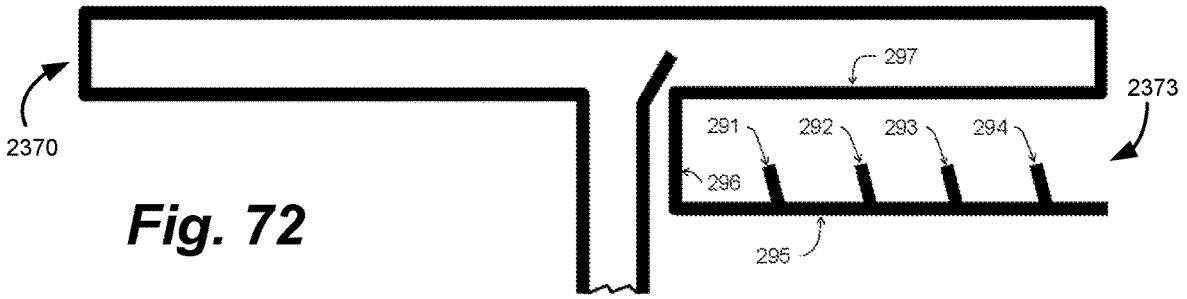
FIG. 72 shows a cross sectional view of an alternative embodiment of an exemplary front receiving center with pierced lifted perforation tabs.

Also, one or more of the surfaces 282, 283 and 284 on the inner side of the receiving center 273 can in some embodiments have a process applied to them so the front floor beam material is textured, gnarled or roughened as to provide additional gripping unto the decking material when it is closed shut. This will help keep the decking material from slipping out over time. The process can be pre-formation or post-formation of the front floor beam 3300 structure, or the desired surface "texture/shape" can be inherent to the front floor beam 3300 material being used. Further, Surfaces 282, 283 and 284 on the inner side of the receiving center 273 can partially or fully have creases with ridges or radiuses formed into the material as shown in FIGS. 71 and 72. Additionally, surfaces 276, 279 and 281 can in some embodiments be convex or radiused outwardly, facing away from the floor beam 3300.

FIG. 71 shows a cross sectional view of an alternative front floor beam 2360 with a receiving center 2273, wherein it has one or more triangle shaped teeth 285, 286, 287, 288, 289 and 290. These teeth help grip the decking material (not shown) when closed shut. It will be appreciated that these teeth can have several optional shapes including hexagon, box, sinusoidal, off center, dome or other. Further, there can be more or less than five teeth in the receiving center 2273. Additionally, the teeth can be formed in different locations throughout the receiving center 2273. The outward hook 290 can wedge itself against the decking material when the receiving center 2273 is closed (for example, by natural tension or via crimping, etc.). The teeth and/or the hook grip the decking material of the bridge portion to help hold it in place.

FIG. 72 shows a cross sectional view of an alternative front floor beam 2370 with a receiving center 2373, wherein it one or more pierced lifted perforation tabs 291, 292, 293 and 294 connected at the base of the receiving center floor 295 that can help grip the decking material (not shown) when closed shut. It will be appreciated that the lifted perforation tab(s) can be parallel or non-parallel, perpendicular or non-perpendicular to the longitudinal axis of the front floor beam. Further, there can be more or less than four lifted perforation tabs in the receiving center 2373. The lifted perforations can be formed in different locations throughout the receiving center surfaces including the bottom 295, back side 296 and top 297.

Figure 73:
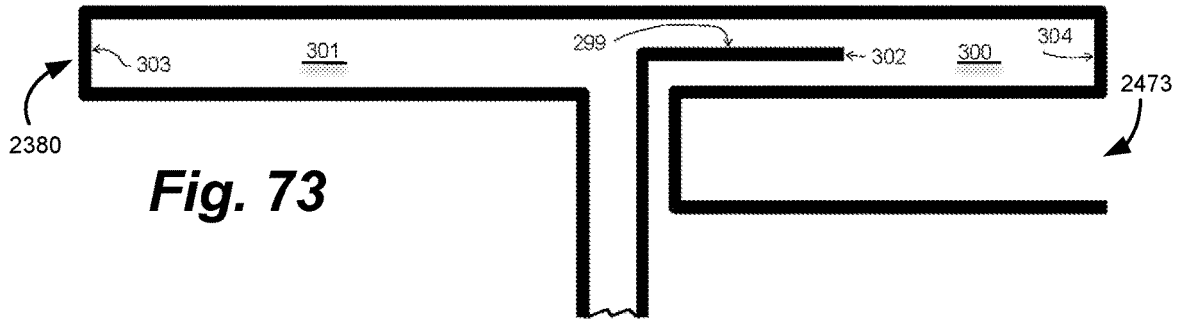
FIG. 73 shows a cross sectional view of an alternative embodiment of an exemplary front receiving center with a modified inner tab.

FIG. 73 shows a cross sectional view of an alternate front floor beam 2380 where the inner tab 299 does not need to be angled, it can form itself inside the upper interior surfaces on the right side space 300, or it will be appreciated that it can form itself in the left side 301. Further, the tip 302 of the tab 299 can extend partially in either the space 300 or 301, or fully against surfaces 304 or 303.

Figure 74:
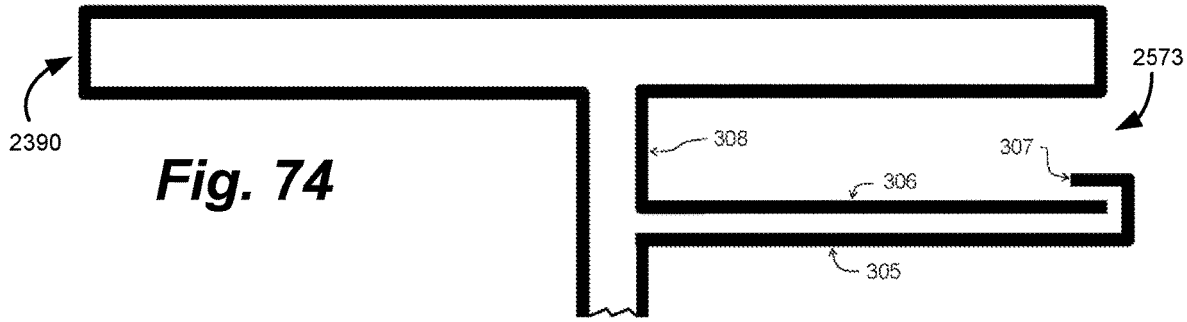
FIG. 74 shows a cross sectional view of an alternative embodiment of an exemplary front receiving center where outward tab is disposed in the receiving center.

FIG. 74 shows a cross sectional view of a front floor beam 2390 where the outward tab 307 is disposed in the receiving center 2573, extending around the bottom surface 305. An underside 306 of the receiving center 2573 extends to meet the back wall 308 of the receiving center 2573. It will be appreciated, that the end of the outward tab 307 can extend partially or all the way across surface 306 and be positioned adjacent to surface 308, the back of the receiving center 2573.

Figure 75:
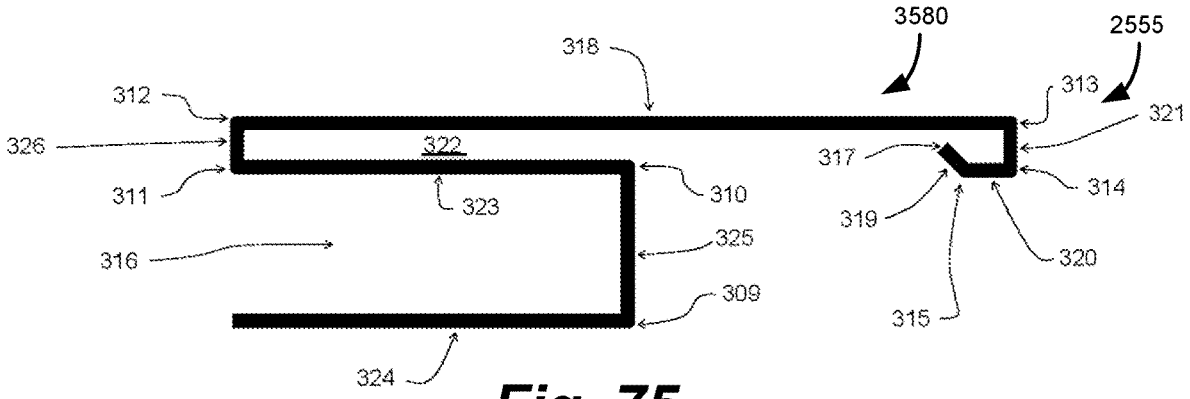
FIG. 75 shows a cross sectional view of an exemplary roof attachment portion with a receiving center.

FIG. 75 shows a cross-sectional view of an example of an exemplary roof attachment portion (back floor beam) 3580. In this embodiment, it has seven corners 309, 310, 311, 312, 313, 314 and 315. It will be appreciated that in other exemplary embodiments, the back floor beam 3580 can be made with more or less than seven corners. A receiving center 316 can be shaped like a channel or have a configuration to receive the decking of the bridge portion (not shown) and then later closed shut in the manufacturing process to firmly secure the bridge portion. On the other side of the back floor beam 3580, a back angled tab 317 is bent towards a top surface 318. The back tab 317 can be close to the surface 318 or adjacent to it. The back section 2555 of 317, 319, 315, 320, 314, 321 and 313 form a "non jagged" edge so it can slide easily under the roof shingles by the installer. Not having a sharp back section 2555 edge helps to avoid ripping the roofing paper beneath the shingles. In other embodiments, the back section 2555 can obtain a non-sharp edge by curling, rolling, blunting the terminal end of the back section 2555. The degree of curling or blunting chosen can be design dependent.

While FIG. 75 shows an open space between surface 318 and 323 of the back floor beam 3580, it will be appreciated that there will be little to no space between these surfaces once the device is produced due to the manufacturing process. The open space in this diagram is to better show the attributes and purpose of the surfaces and their interaction with each other. It will be further appreciated that the interior of floor beam surfaces 318 and 323 can have an applied adhesive, glue, foam, injectant, material or other type of adherent to assist in helping the walls retain rigidity over time. Further, in addition to just closing shut the receiving center 316 surface 324 against upper surface 323 an adhesive or glue, foam, injectant, material or other type adherent can be applied on a portion of or all of surfaces 323, 324 and 325 on the inner side of the receiving center 316 prior to inserting the decking material. This would provide additional locking forces to anchor the decking material in the receiving center. In addition, surfaces 323, 324 and 325 on the inner side of the receiving center 316 can have a process applied to them so the material is textured, gnarled or roughened as to provide additional gripping unto the decking material when it is closed shut. This will help keep the decking material from slipping out over time. The process can be pre-formation or post-formation of the back floor beam 3580 structure, or the desired surface "texture/shape" can be inherent to the back floor beam 3580 material being used.

Figure 76:
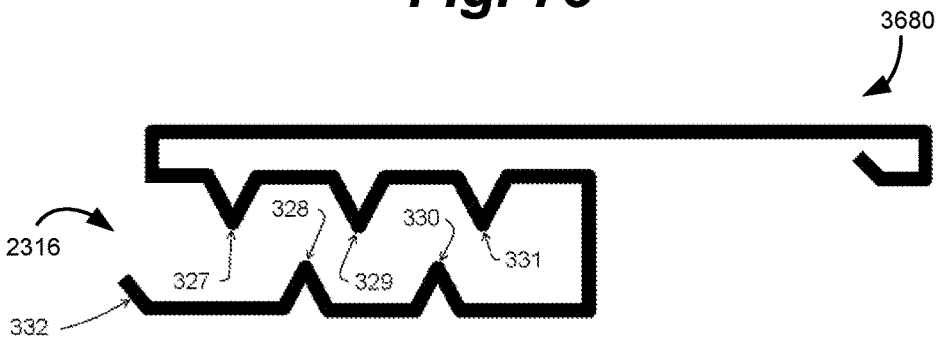
FIG. 76 shows a cross sectional view of an alternative embodiment of a receiving center of an exemplary rear floor beam.
Figure 77:
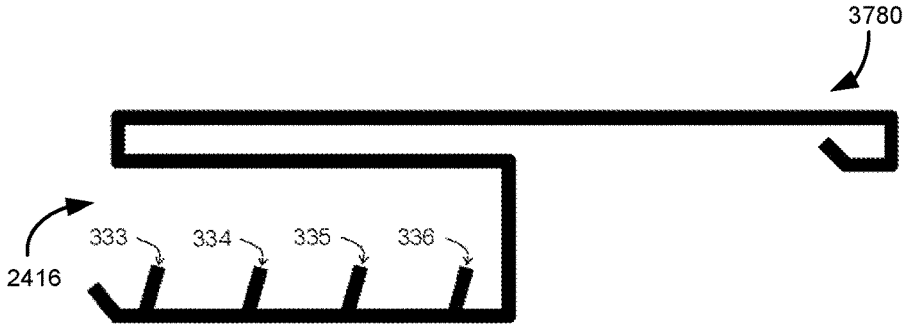
FIG. 77 shows a cross sectional view of an alternative embodiment of a receiving center with perforation tabs for an exemplary rear floor beam.

It will also be appreciated that the surfaces 323, 324 and 325 on the inner side of the receiving center 316 can partially or fully have creases with ridges or radiuses formed into them as shown in FIGS. 76 and 77. Surfaces 323, 324 and 325 can also be concaved inwardly or radiused outwardly away from the back floor beam 3580.

FIG. 76 shows an alternative embodiment of a receiving center 2316 of an exemplary rear floor beam 3680. This receiving center 2316 includes triangle shaped teeth 327, 328, 329, 330 and 331. The teeth are operably configured to engage and grip the decking material (not shown) of the bridge portion when inserted therein (or when the receiving center 2316 is physically "closed"). It will be appreciated that in other exemplary embodiments, that theses teeth can have other shapes including hexagon, box, sinusoidal, off center, dome or other. Further, there can be more or less than five teeth in the receiving center 2316. Additionally, the teeth can be formed in different locations throughout the receiving center surfaces. Also, the outward hook 332 can be configured to wedge itself against the decking material (not shown) when the receiving center 2316 is closed. The teeth or the hook can grip the decking material to help hold it in place.

FIG. 77 shows an alternative embodiment of a receiving center 2416 of an exemplary rear floor beam 3780. This receiving center 2416 has pierced lifted perforation tabs 333, 334, 335 and 336 connected at the base of the receiving center floor. These tabs are operable configured to engage and help grip the decking material (not shown) of the bridge portion when closed (by natural tension or via crimping, etc.). It will be appreciated, that the lifted perforation tabs can be parallel or non-parallel, perpendicular or non-perpendicular to the longitudinal axis of the rear floor beam 3780. Further, there can be more or less than four lifted perforation tabs in the receiving center 2416. Additionally, the lifted perforations can be formed in different locations throughout the receiving center surfaces including the bottom surface, side surface and upper surface.

Figure 78:
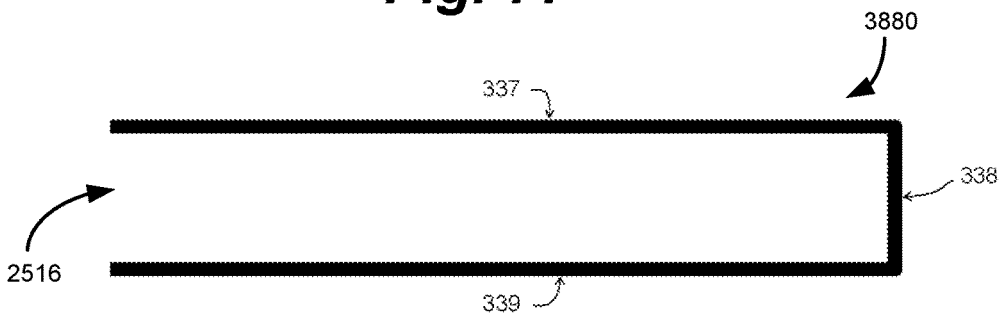
FIG. 78 shows a cross sectional view of an alternative embodiment of a receiving center a sideways U shape for an exemplary rear floor beam.

FIG. 78 shows an alternative embodiment of a receiving center 2516 of an exemplary rear floor beam 3880. This receiving center 2516 is shaped like sideways "U" with only three sides 337, 338 and 339. Sides 337 and 339 are shown as being approximately parallel, however, in various embodiments, they may be slightly off-parallel, narrowing towards side 338 or vice versus. The receiving center 2516 can provide all the same attributes as those from FIGS. 75, 76 and 77.

FIGS. 79-85 illustrate alternative embodiments of exemplary bridge portions. Particularly, these embodiments have a decking of the bridge portion that includes at least one or more barricade(s). Barricades are localized deformations or shape changes disposed within the bridge portion and, in of themselves, do not provide self-supporting capabilities to the bridge portion. A barricade is essentially a water barricade disposed in the decking between girders. The barricades can be recessed or bumped areas in the decking material, whether the decking be a mesh material, a perforated sheet material, or anything else. Because rainwater, after penetrating through the decking material, typically adheres to the underside of decking while traveling down the device, various shaped obstacles, such as the barricades, formed into the material decking will assist in redirecting the water to drop into the gutter. The early release of water from the decking into the gutter allows non-penetrating water traveling or resting on the top of the decking to now penetrate more easily. This feature operates to increase the drainage rate for a given decking area.

Figure 79:
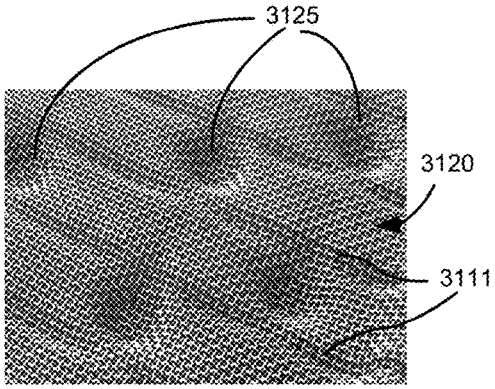
FIG. 79 is a perspective view of an illustration of a recessed barricade in a micromesh decking.
Figure 80:
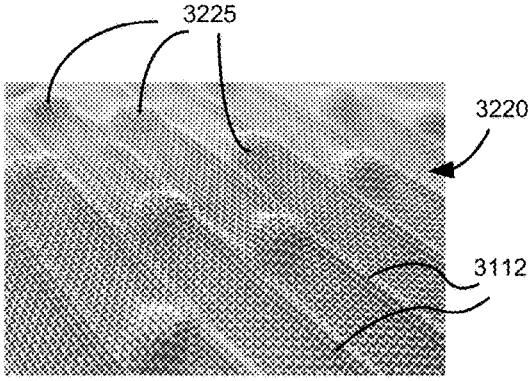
FIG. 80 is a perspective view illustrating a bumped barricade in a micromesh decking.

FIG. 79 is an illustration of a recessed (e.g., dimpled) barricade 3125 in a micromesh decking 3120. The barricade 3125 is considered recessed because it is formed in the mesh 3120 such that the barricade 3125 extends down from the plane of the decking 3120. "Lines" 3111 are artifacts from the photograph used for FIG. 79 and are not grooves or different barricades, and will be ignored for the purposes of this discussion. FIG. 80 illustrates a bumped (reverse dimple) barricade 3225 in a micromesh decking 3220. The barricade 3225 is considered bumped because it is formed in the mesh 3220 such that the barricade 3225 extends up from the plane of the decking 3220. "Lines" 3112 are artifacts from the photograph used for FIG. 80 and are not grooves or different barricades and will be ignored for the purposes of this discussion.

The above barricades apply tension on the plane woven wires of the micromesh, which tightens and strengthens the mesh making it more rigid, sturdy, less prone to sagging and able to withstand heavier loads. It will be appreciated that the barricades can take a variety of shapes and designs, whether it is on a mesh or perforated. sheet type material. The shapes of the barricades can be of a plethora of designs and disposed in any order. The barricades can be mixed together with other designed shapes, positioned in any location, positioned in any direction and at any angle.

It will be appreciated that the barricade can be a separate material affixed to the bridge portion or it could be an impression formed directly in the material of the bridge portion.

It will be appreciated that having a recessed barricade on the bottom surface protruding into the gutter opening when in use, will aide in diverting rain water into the gutter. Further, having barricades with orifices (larger that the mesh orifice) will further accelerate water penetration. It will be appreciated that having a barricade-like structure on the top surface protruding away from the gutter opening when in use, will aide in preventing debris from not collecting on the bridge portion. Particularly, leaves can often be wet and when wet will not readily move off. Having the barricade-like structure will allow a leaf, or the like to span from the top surface of the bridge portion to the barricade-like structure. In this arrangement, the leaf will tend to dry out quicker. Being drier will allow the wind to blow the leave off the gutter. Further, with a gap below the leaf, wind can pass below the leaf, enabling faster drying of the leaf. Still further, the gap allows wind to travel below the leaf and this increases the likelihood the leaf will be blown off of the device.

Figure 81:
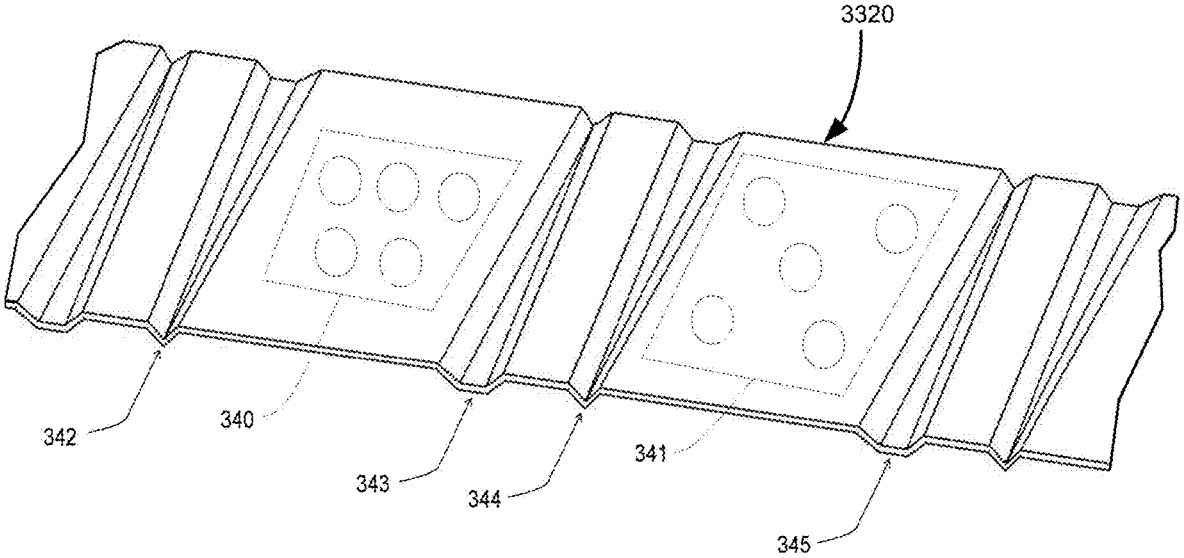
FIG. 81 illustrates a perspective view of an alternative embodiments of barricades.

FIG. 81 illustrates alternative embodiments of barricades 340, 341, wherein recessed or bumped decking material can be from in the bridge portion 3320. The barricades 340, 341 in this embodiment have a circular shape. The barricades 340, 341 are grouped together in clusters of five with different spacing therein. The barricades 340, 341 are disposed on the bridge portion 3320 between grooves 342 and 343, and 344 and 345, respectively. Cluster of barricades 340 is disposed on the decking between grooves 342 and 343. Cluster of barricades 340 is disposed on the decking between grooves 344 and 345. More or less than five barricades can be in a given cluster. The circular shapes of the barricades can be very small in diameter and as large as the span between the between neighboring grooves or groove pairs. It will be appreciated that the recessed or indented barricades can be of any shape including oval, regular or irregular quadrilaterals, regular or irregular polygons, concave or convex contours or a mix of several shapes.

Figure 82:
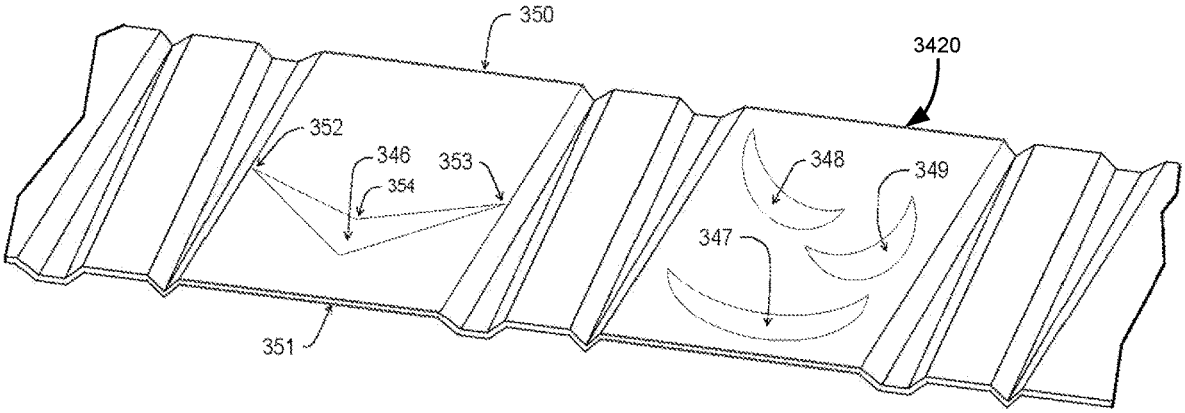
FIG. 82 illustrates a perspective view of an embodiment of an exemplary bridge portion having arrow shaped barricades.

FIG. 82 illustrates an embodiment of an exemplary bridge portion having arrow shaped barricades 346, as well as crescent shaped barricades 347-349 disposed on the decking 3420 between the grooves. With these recessed or bumped shapes, rainwater traveling down from the roof towards the back 350 of the decking 3420 to the front 351 of the decking 3420 will be trapped and channeled into the gutter through the orifices, not shown, in the decking 3420. Barricade 346 is in the shape of an arrow. The arrow barricade 346 include narrowed ends 352 and 353 and a center apex 354. Barricades 347, 348 and 349 are crescent shaped. It will be appreciated that the crescent shapes may be oriented in a variety of directions relative to the front 351. As with the arrow shaped barricade 346, crescent shaped bumps or recessions in the decking 3420 will enhance the rate of rainwater dropping into the gutter. It will be appreciated that, generally speaking, more barricades in a given space will tend to increase the rate of rainwater dropping into the gutter.

Figure 83:
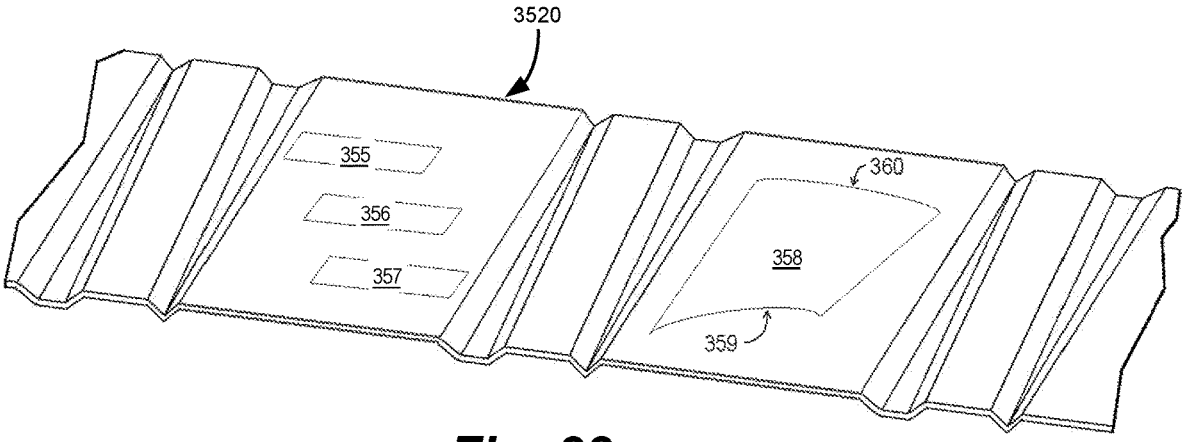
FIG. 83 shows a perspective view of an embodiment of an exemplary bridge portion having a set of staggered rectangular barricades.
Figure 84:
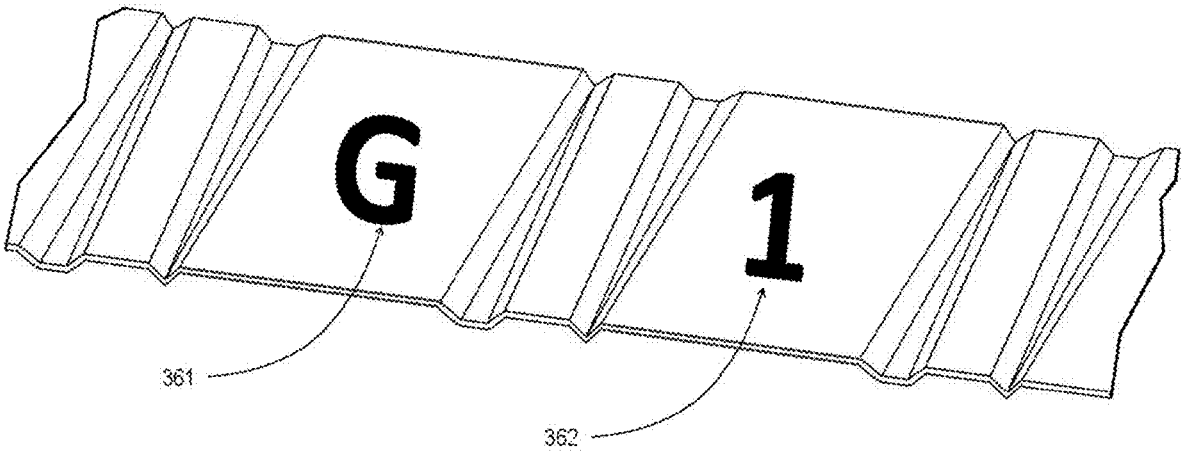
FIG. 84 shows a perspective view of an embodiment of an exemplary bridge portion with a letter-shaped barricade and a number-shaped barricade.
Figure 85:
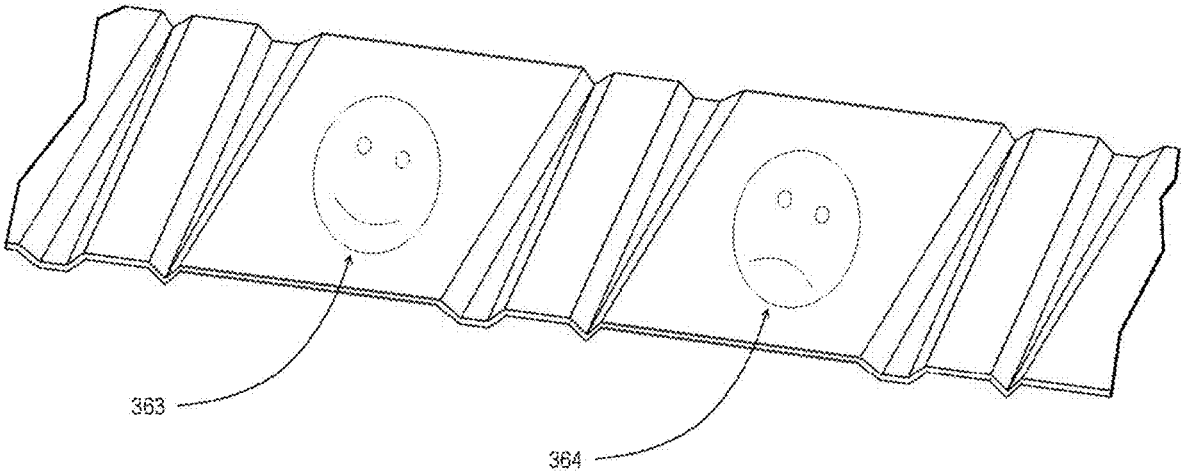
FIG. 85 shows a perspective view of an embodiment of an exemplary bridge portion with emoji-like image shaped barricades.

FIGS. 83, 84 and 85 illustrates examples of alternative shapes for exemplary barricades. Particularly, FIG. 83 shows a set of staggered rectangular barricades 355, 356 and 357 disposed in the decking 3520 between adjacent grooves. In the right decking section is barricade 358, having an irregular quadrilateral shape with sides 359 and 360. It will be appreciated that the barricades can have one or more concave or convex sides.

Shaped designs of barricades can also make the decking of the device more aesthetic. For example, FIG. 84's embodiment shows that barricade 361 has the shape of a letter and barricade 362 has the shape of a number. Letter shaped barricades can be formed into brand names or other information and stamped in this area providing immediate identification of what product it is or who the manufacturer is. FIG. 85 shows an embodiment where the exemplary decking can also have one or more of many barricade designs, such as an emoji-like image, etc. A smiley faced barricade 363 is shown in this Fig. as well as a sad face shaped barricade 364. Accordingly, it is understood that arbitrary shapes, sizes, contours and so forth can implemented for a barricade, according to design preference.

It will be appreciated that in other various exemplary embodiments, recessed barricades and bumped barricades can be combined on the same device.

Figure 86:
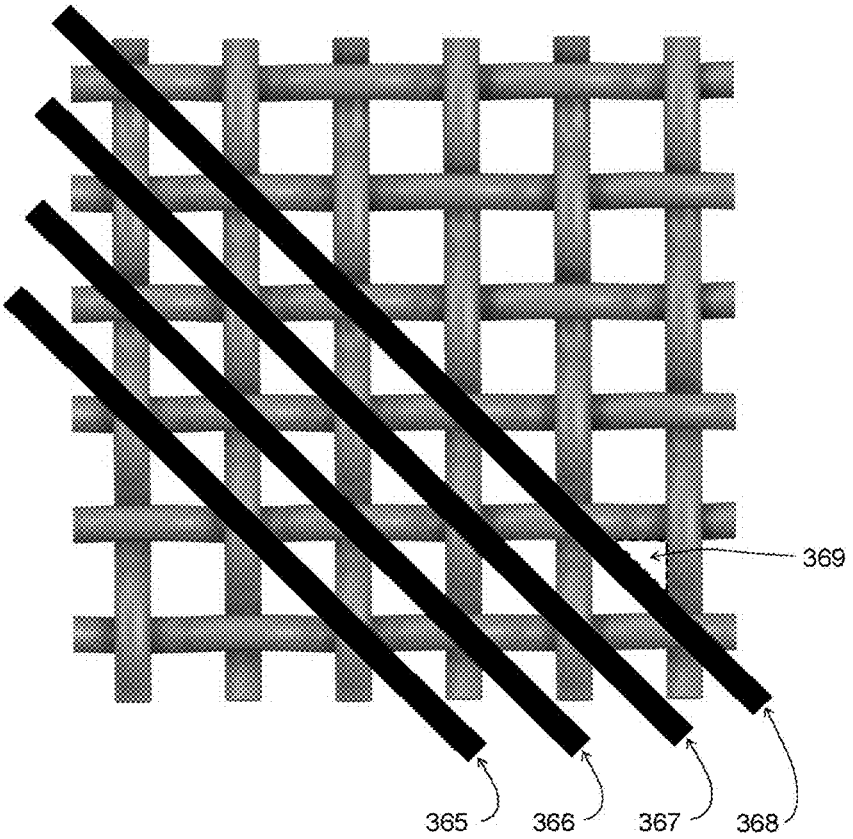
FIG. 86 shows a top view of an exemplary interwoven micromesh.

FIG. 86 shows an exemplary interwoven micromesh. As opposed to the traditional woven micromesh material where all spacing between the wires consist of quadrilateral squares or rectangles, diagonally woven-in wires 365, 366, 367 and 368 to these equilateral squares to form isosceles triangle units 369. This arrangement will provide the grooves with a triangular shaped web configuration providing additional load bearing attributes as in a traditional latticed bridge. In various embodiments, the above interwoven mesh type is used in the decking of the bridge portion, for one or more of a barricade, groove, truss, or girder, and so forth.

Figure 87:
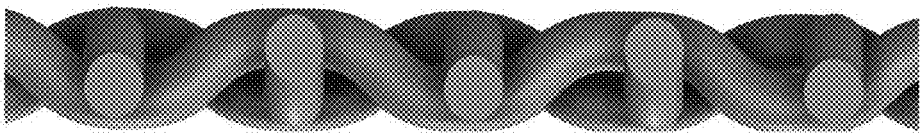
FIG. 87 shows a cross sectional side view of an exemplary woven micromesh material prior to being stretched through a forming process.
Figure 88:
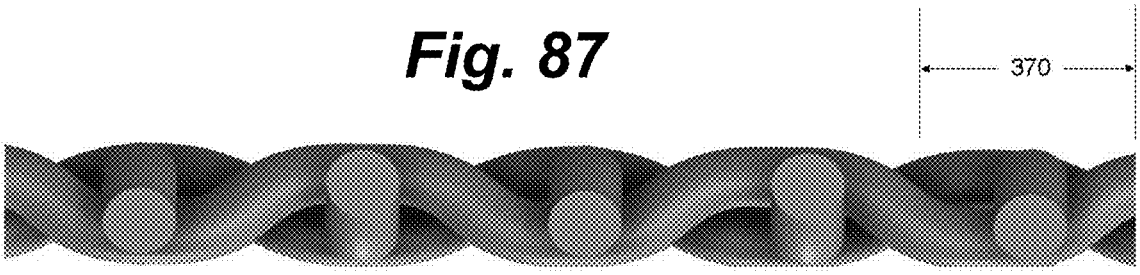
FIG. 88 shows a cross sectional side view of the same section of micromesh in FIG. 87, but after it is stretched.

FIG. 87 shows an exemplary woven micromesh material prior to being stretched through a forming process. FIG. 88 shows the same section of micromesh in FIG. 87, but after it is stretched 370. The tensioning process during manufacturing creates a stiffness in the micromesh and slightly increases the length. Tensioned wires are less likely to be compromised under increased loads on the micromesh decking because the woven wires are no longer pre-disposed to flexing due to loads exerted on the decking material. Stretched or tensioned woven wires reduces the flexible droopiness and sagging that can exist in the micromesh decking. Tensioned dual-girder micromesh allows for a more rigid vertical and horizontal cross wires.

In view of the various "groove" embodiments described above, it is understood that the grooves may have different shapes, sizes, orientations, depths, heights, lengths, etc. from those shown. Further, while the bulk of the groove discussion is in the context of irregular grooves, it is understood that "regular" grooves may be wholly implemented in various embodiment of the device(s) or partially (i.e., with irregular grooves). The choice is a design consideration. For example, a device having 100% regular grooves or less than 100% regular grooves spanning the bridge portion may be made, wherein the shape or size is constant along the length of the groove. Moreover, combinations of regular grooves and irregular grooves are possible, within the same groove structure. That is, an irregular groove may "change" into a regular groove at some point along the bridge portion (or decking), or vice versus.

Figure 89:
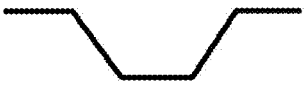
FIG. 89 shows a rear profile of a regular groove with a half hexagon shape.
Figure 90:
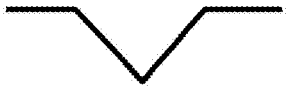
FIG. 90 shows a rear profile of a regular groove with a triangular shape.
Figure 91:
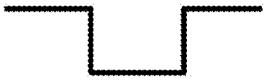
FIG. 91 shows a rear profile of a regular groove with a "box" shape.
Figure 92:
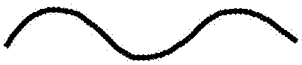
FIG. 92 shows a rear profile of a regular groove with a sinusoidal shape.
Figure 93:
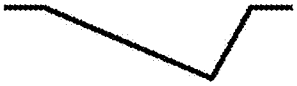
FIG. 93 shows a rear profile of a regular groove with an off center shape.
Figure 94:
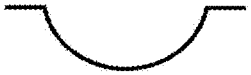
FIG. 94 shows a rear profile of a regular groove with a "dip" shape.

FIGS. 89-94 are examples of possible constant profiles of regular grooves that may be implemented in the exemplary device(s). FIG. 89 shows a profile with a half hexagon shape, FIG. 90 shows a profile with a triangular shape, FIG. 91 shows a profile with a "box" shape, FIG. 92 shows a profile with a sinusoidal shape, FIG. 93 shows a profile with an off center shape, and FIG. 94 shows a profile with a "dip" shape.

Further, it is expressly understood and within the scope of this disclosure that the grooves (irregular and/or regular) may "terminate" prior to reaching a respective longitudinal end the bridge portion. That is, one or more exemplary grooves may start at an arbitrary imaginary line displaced inward from an end of the bridge portion, or end at an arbitrary imaginary line displaced inward from the other end of the bridge portion (i.e., gutter lip side or roof side). Of course, there can be one than one starting/ending "line" for a groove or groove type. Accordingly, for "short" groove structures that end at these inward line(s) within the bridge portion, the groove structure may require a height/depth adjustment at that transition point to be flush with the bridge portion's deck. Concomitant with the above discussion is the understanding that one or more creases in the deck may be required to compensate for the above groove structures' effect on the deck's "flatness."

Further, not discussed but also understood to be within the scope of this disclosure is the fact that the termination of the groove's end at the bridge portion ends (front and/or back) may be more than a deformation of the deck that still maintains the integrity of the mesh (or decking material). It is possible that a deformation may "break" the mesh (or the decking material), however, such a break may be purposeful to allow the groove to obtain its desired height/depth without resorting (if necessary) to a crease. Further on this point, such breaks may be judicially designed into specific positions, places along or near a groove or barricade ridge to allow water to more quickly travel into the gutter (through the break), while still avoiding debris entrance into the gutter. As one non-limiting example, a break in the mesh (or decking material) may be designed to have the roof side end of the break higher than the gutter lip side end, thus providing a "stair-step" for debris to travel/skip over, while water may flow into the break's gap. Of course, other break types as well as locations are possible, understating the judicious implementation can increase the device's water capture rate while still acting as debris barrier (e.g., gutter guard.

In view of the above discussions of the various exemplary grooves being formed in the decking material, it is understood that while the examples shown are typically for a mesh-like bridge portion or sheet-like bridge portion (having perforations), it may be possible to obtain one or more of the same groove structures (as well as proposed breaks) using a non-metallic material. It is specifically contemplated that a form of plastic (mesh or sheet) or some laminate material can be deformed (or injection molded, heated, etc.) to form the desired shapes described herein. Further, various elements of the exemplary device may be made from different materials, non-limiting examples being the front and/or rear beams formed from a plastic, etc. or vice versus. Accordingly, one of ordinary skill in the art may devise other combinations and alterations recognizing such changes fall wholly within the breath and spirit of this disclosure.

It is expressly understood that the at least one groove present in the exemplary embodiments described herein provide one or more important features to the gutter device. One specific feature is the structure of the groove disposed in the bridge portion provides the gutter guard device with sufficient rigidity to enable it to be self-supporting over the span of a gutter without the need for other supporting elements found in the prior art—such, as, for example, an underlying rigid frame support for the mesh, a plurality of corrugations formed in the mesh or the like. Notwithstanding the above, it will also be appreciated that the at least one groove can, in other embodiments, be combined with these other structural supporting elements to further increase the load carrying capacity of the device, if so desired.

As noted above, for purposes of clarity, the decking material of the bridge portions of all the above illustrated embodiments include orifices even though the various illustrations do not show the orifices. Further, it will be appreciated that the bridge portion may be utilized as the complete gutter guard without the roof attachment portion and/or the gutter attachment portion.

While this invention has been described in conjunction with the specific embodiments outlined above, it is evident that many alternatives, modifications and variations will be apparent to those skilled in the art. Accordingly, the described embodiments of the invention, as set forth above, are intended to be illustrative, not limiting. Thus, various changes and combinations thereof may be made without departing from the spirit and scope of this invention. When structures are identified as a means to perform a function, the identification is intended to include all structures, which can perform the function specified.

What is claimed is:

1. A gutter guard device comprising:

a bridge member composed of a decking material having a plurality of orifices throughout its entirety, and having a roof side and an opposing gutter lip side;

at least one groove disposed in the decking material altering a profile of the deck material to outline a 3-dimensional geometry that spans the bridge member from a proximal end of the bridge member's roof side to a proximal end of the bridge member's gutter lip side, wherein a surface of a groove of the at least one groove is faceted with joined polygons, at least one of the joined polygons forming a triangular profile at a first end of the groove and forming a half-hexagonal profile at an opposite end of the groove;

a roof attachment member configured to attach to the roof side of the bridge member; and a gutter attachment member configured to attach to the gutter lip side of the bridge member;

wherein the 3-dimensional geometry of the at least one groove enables the gutter guard device to be self-supporting.

2. The gutter guard device of claim 1, wherein the at least one groove forms an inverted channel across the bridge member.

3. The gutter guard device of claim 1, wherein a plane of a top surface of the at least one groove is at an inclination or declination to a plane of the decking material.

4. The gutter guard device of claim 1, wherein the at least one groove is attached to the bridge member.

5. The gutter guard device of claim 1, wherein the at least one groove is irregular, having a cross-sectional profile that is not constant along a major axis of the at least one groove.

6. The gutter guard device of claim 5, wherein the at least one groove is a 3-dimensional polygon.

7. The gutter guard device of claim 1, wherein a first cross-sectional profile of the at least one groove has a shape of at least one of a hexagon, half-hexagon, triangle, box, sinusoid, off center, dip, and V.

8. The gutter guard device of claim 7, wherein a second cross-sectional profile of the at least one groove has a different shape than the first cross-sectional profile's shape.

9. The gutter guard device of claim 7, wherein a second cross-sectional profile of the at least one groove has a different size than a size of the first cross-sectional profile's shape.

10. The gutter guard device of claim 1, wherein a first groove of the at least one groove is in a reversed orientation to a second groove of the at least one groove.

11. The gutter guard device of claim 1, wherein a first groove of the at least one groove is adjacent and displaced a first distance from a second groove of the at least one groove to form a first set of grooves, the first set of grooves being displaced from another different set of grooves by a second different distance.

12. The gutter guard device of claim 11, wherein the first set and the another set of grooves are in reverse orientation to each other.

13. The gutter guard device of claim 1, further comprising a crease disposed in the decking material in at least one of the roof side and a gutter lip side of the bridge member, the crease extending partially across the bridge member and compensating for the at least one groove's use of the decking material.

14. The gutter guard device of claim 13, wherein the crease outlines a polygonal shape.

15. The gutter guard device of claim 1, wherein a first groove of the at least one groove is adjacent and displaced a first distance from a second groove of the at least one groove, the first and second grooves composed of joined segmented archways and sharing a ramp therebetween to form a skyway, and wherein a third groove of the at least one groove is displaced a second distance from the skyway, the third groove composed of joined smaller segmented archways.

16. The gutter guard device of claim 1, wherein adjacent grooves of the at least one groove form a series of mid-point shifted grooves, wherein first ends of the adjacent grooves have an upper half-hexagonal profile disposed above a plane of the bridge portion and opposite ends of the adjacent grooves have a lower half-hexagonal profile disposed below the plane of the bridge portion.

17. The gutter guard device of claim 1, wherein the bridge member is a micro-mesh material.

18. The gutter guard device of claim 17, wherein the micro-mesh material is pre-tensioned.

19. The gutter guard device of claim 18, wherein the micro-mesh includes inter-woven diagonal strands of material.

20. The gutter guard device of claim 1, wherein the bridge member is a perforated sheet of aluminum.

21. The gutter guard device of claim 1, wherein the at least one groove is a plurality of grooves.

22. The gutter guard device of claim 1, wherein a first groove of the at least one groove has a different height than a second groove of the at least one groove.

23. The gutter guard device of claim 1, further comprising at least one barricade disposed in the bridge member.

24. The gutter guard device of claim 23, wherein the at least one barricade has a shape of a number, letter, circle, arrow, crescent, bump, dimple, and polygon.

25. The gutter guard device of claim 23, wherein the at least one barricade is a plurality of barricades.

26. The gutter guard device of claim 23, wherein the at least one barricade is not made from the bridge member's decking material.

27. The gutter guard device of claim 1, wherein at least one of the roof attachment member and gutter attachment member have a receiving center configured for securing the bridge member to the respective attachment member.

28. A gutter guard device, comprising:

a bridge member having a decking material, the decking material being composed of a plurality of orifices throughout the material, and a roof side and an opposing gutter lip side;

at least one irregular groove disposed in the decking material and having a length that extends at least partially from the roof side to the opposing gutter lip side of the decking material;

a roof attachment member configured to attach to the roof side of the bridge member; and a gutter attachment member configured to attach to the gutter lip side of the bridge member;

wherein the at least one irregular groove, has a three-dimensional profile along the length, and the three-dimensional profile is varied at different locations of the length and wherein a surface of the at least one irregular groove is faceted with joined polygons, the joined polygons forming a triangular profile at a first end of the irregular groove and forming a half-hexagonal profile at an opposite end of the irregular groove; and, wherein the at least one irregular groove enables the device to be self-supporting.

29. The gutter guard device of claim 28, wherein:

the decking material has a center plane; and the three-dimensional profile of the at least one irregular groove extends below the center plane along a first portion of the length of the at least one irregular groove and extends below the center plane along a second portion of the length of the at least one irregular groove.

30. A gutter guard device, comprising:

a bridge member having a decking material, the decking material having a plurality of orifices throughout its entirety, and a roof side and an opposing gutter lip side; and, at least one irregular groove disposed in the decking material and having a length that extends from the roof side to the opposing gutter lip side of the decking material;

wherein the at least one irregular groove, has a three-dimensional profile along the length, and the three-dimensional profile is varied at different locations of the length and wherein a surface of the at least one irregular groove is faceted with joined polygons, the joined polygons forming a triangular profile at a first end of the irregular groove and forming a half-hexagonal profile at an opposite end of the irregular groove; and, wherein the at least one irregular groove enables the device to be self-supporting.

31. The gutter guard device of claim 30, wherein:

the decking material has a center plane; and the three-dimensional profile of the at least one irregular groove extends below the center plane along a first portion of the length of the at least one groove and extends below the center plane along a second portion of the length of the at least one groove.

* * * * *